US009188076B2

(12) United States Patent
Kai et al.

(10) Patent No.: US 9,188,076 B2
(45) Date of Patent: Nov. 17, 2015

(54) FUEL INJECTION CONTROL SYSTEM

(75) Inventors: Seiichi Kai, Kobe (JP); Osamu Tani, Kobe (JP); Masakazu Noro, Kakogawa (JP); Tetsuya Masuda, Akashi (JP)

(73) Assignee: Kawasaki Jukogyo Kaisha, Kobe-shi (JP)

( * ) Notice: Subject to any disclaimer, the term of this patent is extended or adjusted under 35 U.S.C. 154(b) by 884 days.

(21) Appl. No.: 13/449,236

(22) Filed: Apr. 17, 2012

(65) Prior Publication Data

US 2012/0265423 A1 Oct. 18, 2012

(30) Foreign Application Priority Data

Apr. 18, 2011 (JP) ..... 2011-092367

(51) Int. Cl.
*F02D 41/30* (2006.01)

(52) U.S. Cl.
CPC ..... *F02D 41/30* (2013.01); *F02D 41/3094* (2013.01)

(58) Field of Classification Search
CPC .. F02D 19/0692; F02D 41/30; F02D 41/3094
USPC ..... 701/103, 104, 110; 123/299, 300, 304, 123/399, 431, 436, 445, 472, 478, 480
See application file for complete search history.

(56) References Cited

U.S. PATENT DOCUMENTS

| | | | | |
|---|---|---|---|---|
| 6,928,983 | B2 * | 8/2005 | Mashiki | 123/431 |
| 7,150,266 | B2 * | 12/2006 | Nakayama et al. | 123/431 |
| 7,216,627 | B2 * | 5/2007 | Ito et al. | 123/406.47 |
| 7,234,447 | B2 * | 6/2007 | Okubo et al. | 123/431 |
| 7,270,112 | B2 * | 9/2007 | Kinose | 123/431 |
| 7,273,043 | B2 * | 9/2007 | Okubo et al. | 123/520 |
| 7,620,488 | B2 * | 11/2009 | Kaneko | 701/103 |
| 7,694,507 | B2 * | 4/2010 | Tokuda | 60/284 |
| 7,769,523 | B2 * | 8/2010 | Matsushima et al. | 701/103 |
| 8,739,760 | B2 * | 6/2014 | Hokuto et al. | 123/299 |
| 2005/0274353 | A1 * | 12/2005 | Okubo et al. | 123/299 |
| 2006/0107650 | A1 * | 5/2006 | Tokuda | 60/284 |
| 2006/0207555 | A1 * | 9/2006 | Ito et al. | 123/406.47 |
| 2008/0257304 | A1 * | 10/2008 | Noda et al. | 123/305 |
| 2009/0272367 | A1 * | 11/2009 | Aliakbarzadeh et al. | 123/673 |
| 2012/0024258 | A1 * | 2/2012 | Hokuto et al. | 123/299 |

FOREIGN PATENT DOCUMENTS

| | | | |
|---|---|---|---|
| JP | 2006-132371 | A | 5/2006 |
| JP | 2009203826 | A | 9/2009 |
| JP | 2009228447 | A | 10/2009 |

* cited by examiner

*Primary Examiner* — Stephen K Cronin
*Assistant Examiner* — Carl Staubach
(74) *Attorney, Agent, or Firm* — Alleman Hall McCoy Russell & Tuttle LLP

(57) ABSTRACT

A fuel injection control system is provided. The fuel injection control system comprises a first injector and a second injector positioned upstream of the first injector; a memory section which contains a map for defining a correspondence between a running state of an engine and first and second fuel injection ratios; a fuel injection ratio setting section for setting the first fuel injection ratio as a first set value and the second fuel injection ratio as a second set value; and a fuel injection ratio compensation section for making compensation such that the first set value is greater than a value of the first fuel injection ratio derived from the map, when a condition in which the second fuel injection ratio read out from the map is greater in magnitude than a predetermined determination criterion is met.

17 Claims, 29 Drawing Sheets

73

| DEVIATION INJ2_RDEV | 0.0 | 0.6 | 0.8 | 0.9 | ··· |
|---|---|---|---|---|---|
| FUEL-RICH COEFFICIENT INJ1MRICH | 1.00 | 1.00 | 1.02 | 1.05 | |

Fig. 18

74

| CHANGE RATE ΔTH OF THROTTLE VALVE OPENING DEGREE | −2 | −4 | −6 | −8 | ··· |
|---|---|---|---|---|---|
| SECOND SET VALUE INJ2_RSET | 0.4 | 0.2 | 0.1 | 0 | |

Fig. 28

FUEL INJECTION CONTROL SYSTEM

CROSS-REFERENCE TO RELATED APPLICATION

The present application claims priority to and the benefit of Japanese Patent Application No. 2011-92367 filed on Apr. 18, 2011, which is hereby incorporated by reference in its entirety for all purposes.

BACKGROUND OF THE INVENTION

1. Field of the Invention

The present invention generally relates to a fuel injection control system for controlling twin injectors.

2. Description of the Related Art

Conventionally, there is known an engine including so-called twin injectors (see e.g., Japanese Laid-Open Patent Application Publication No. 2006-132371). The twin injectors include a first injector (primary injector, or downstream injector), and a second injector (secondary injector, or upstream injector) positioned upstream of the first injector in an air flow direction.

The engine including the twin injectors can increase an amount of fuel which can be injected. Since the second injector is positioned more distant from a combustion chamber than the first injector, the fuel injected from the second injector is atomized more easily than the fuel injected from the first injector. When the atomization of the fuel progresses, air is cooled by vaporization and thereby air density increases. For these reasons, it is generally considered that the engine including the twin injectors can increase engine driving power. However, if the air supplied to the combustion chamber is insufficient in amount, the fuel injected from the second injector tends to stagnate in an air-intake passage, which makes it difficult to increase the engine driving power effectively.

To solve this problem, in the engine disclosed in the above publication, a conventional controller controls a setting of a fuel injection ratio of the first injector and a fuel injection ratio of the second injector, to be precise, a ratio of the amount of the fuel injected from the first injector with respect to a total fuel injection amount (a sum of the amount of the fuel injected from the first injector and the amount of the fuel injected from the second injector) and a ratio of the amount of the fuel injected from the second injector with respect to the total fuel injection amount (a sum of the fuel injection ratio of the first injector and the fuel injection ratio of the second injector is 1 (100%)). In this control, when the air amount is less or the engine speed is lower than a predetermined engine speed, the fuel injection ratio of the second injector is smaller than the fuel injection ratio of the first injector. When the air amount exceeds a predetermined amount, the fuel injection ratio of the second injector is greater than the fuel injection ratio of the first injector and is a constant value.

In this case, if the air amount and the engine speed increase rapidly in response to a driver's acceleration request, the fuel injection ratio of the second injector increases rapidly. The second injector is positioned away from the combustion chamber. If the fuel injection ratio of the second injector increases rapidly, the fuel injected from the second injector may reach the combustion chamber at a retarded timing.

On the other hand, since the first injector is positioned closer to the combustion chamber, the fuel injected from the first injector may reach the combustion chamber promptly. However, the fuel injection ratio of the first injector decreases rapidly according to the rapid increase in the fuel injection ratio of the second injector. Because of this, it is presumed that, immediately after the rapid increase in the fuel injection ratio of the second injector, the amount of the fuel actually supplied to the combustion chamber is undesirably less than the amount of the fuel supplied to the combustion chamber immediately before the rapid increase in the fuel injection ratio of the second injector.

In accordance with the conventional control, there is a chance that the amount of the fuel supplied actually to the combustion chamber will become much less than a desired amount for some time. This may result in a low output response during an acceleration state in which high engine driving power is necessary. Under these circumstances, an aim of the use of the twin injectors is not fulfilled.

SUMMARY OF THE INVENTION

The present invention addresses the above described condition, and an object of the present invention is to suppress the fuel actually supplied to a combustion chamber from becoming insufficient in amount when the fuel injection ratio of the second injector is going to be increased.

According to the present invention, a fuel injection control system comprises a first injector for injecting a fuel supplied to an engine; a second injector for injecting the fuel supplied to the engine, the second injector being positioned upstream of the first injector in an air flow direction; a memory section which contains a fuel injection ratio map for defining a correspondence between a running state of the engine, and a fuel injection ratio of the first injector and a fuel injection ratio of the second injector with respect to a total fuel injection amount of the fuel injected from the first injector and the fuel injected from the second injector; a fuel injection ratio setting section for setting the fuel injection ratio of the first injector as a first set value and the fuel injection ratio of the second injector as a second set value, according to the running state of the engine, with reference to the fuel injection ratio map; a fuel injector control section for controlling a fuel injection amount of the first injector according to the first set value, and a fuel injection amount of the second injector according to the second set value; and a fuel injection ratio compensation section for making compensation such that the first set value is greater than a value of the fuel injection ratio of the first injector which is derived from the fuel injection ratio map, when a condition in which the fuel injection ratio of the second injector which is read out from the fuel injection ratio map according to the running state of the engine is greater in magnitude than a predetermined determination criterion is met.

In accordance with this configuration, in a case where the running state of the engine changes rapidly to a state in which the fuel injection ratio of the second injector is greater, the fuel injection ratio of the first injector is increased by compensation. This makes it possible to effectively suppress the fuel supplied to the combustion chamber from becoming insufficient in amount.

The condition may include a condition in which an increase amount of the fuel injection ratio of the second injector which is read out from the fuel injection ratio map according to the running state of the engine, with respect to a past value of the second set value, is greater than a predetermined threshold.

In accordance with this configuration, it is possible to accurately identify a situation where the running state of the engine changes rapidly to the state in which the fuel injection ratio of the second injector is greater.

The memory section may contain a total fuel injection amount map for defining a correspondence between the running state of the engine and the total fuel injection amount; and when the condition is met, the fuel injection ratio compensation section may make compensation in such a manner that the second set value is less than the value of the fuel injection ratio of the second injector which is derived from the fuel injection ratio map in a state where the total fuel injection amount of the fuel injected from the first injector and the fuel injected from the second injector is equal to the total fuel injection amount derived from the total fuel injection amount map.

In accordance with this configuration, since the second set value is decreased by compensation, the first set value is increased by an amount corresponding to the decrease in the second set value, from the value of the fuel injection ratio of the first injector which is derived from the fuel injection ratio map. Even when the first set value is increased passively by decreasing the second set value without changing the total fuel injection amount, it is possible to effectively suppress the fuel supplied to the combustion chamber from becoming insufficient in amount.

When the condition is met, the fuel injection ratio compensation section may make compensation such that an increase rate of the second set value is substantially equal to the predetermined threshold.

In accordance with this configuration, the threshold serves as an increase rate limiter of the second set value. This can implement control for decreasing the second set value and increasing the first set value.

The fuel injection ratio setting section may compare the second set value to a predetermined switch threshold; the fuel injection ratio compensation section may use a first increase rate threshold as the predetermined threshold used to determine whether or not the condition is met, when the second set value is less than the predetermined switch threshold; and the fuel injection ratio compensation section may use a second increase rate threshold greater than the first increase rate threshold as the predetermined threshold used to determine whether or not the condition is met, when the second set value is not less than the predetermined switch threshold.

In accordance with this configuration, a limiter value of the increase rate of the second set value can be changed according to the second set value. The first increase rate threshold is smaller than the second increase rate threshold. Therefore, in a case where the running state of the engine changes rapidly and thereby the fuel injection ratio of the second injector which is derived from the fuel injection ratio map changes from a smaller value to a greater value, an increase in the fuel injection ratio of the second injector is suppressed more, in an initial period of this rapid change. Therefore, it is possible to suppress the fuel from becoming insufficient in amount in the initial rapid of the rapid change.

When the condition is met, the fuel injection ratio compensation section may set the second set value such that an increase rate of the second set value increases gradually.

In accordance with this configuration, the increase rate of the second set value increases gradually with a passage of time. This makes it possible to suitably increase the fuel injection amount of the first injector and quickly finish a state where the second value is decreased by compensation in the initial period of the rapid change in the running state.

The memory section may contain a total fuel injection amount map for defining a correspondence between the running state of the engine and the total fuel injection amount; and when the condition is met, the fuel injection ratio compensation section may make compensation in such a manner that the first set value is greater than a value of the fuel injection ratio of the first injector based on the second set value set not greater than the value of the fuel injection ratio which is derived from the fuel injection ratio map such that the total fuel injection amount of the fuel injected from the first injector and the fuel injected from the second injector is greater than the total fuel injection amount derived from the total fuel injection amount map.

In accordance with this configuration, the first set value is increased by compensation so as to increase the total fuel injection amount. Thus, it is possible to suitably suppress the fuel supplied to the combustion chamber from becoming insufficient in amount even when the first set value is actively increased.

When the condition is met, the fuel injection ratio compensation section may make compensation such that the second set value is less than the value of the fuel injection ratio of the second injector derived from the fuel injection ratio map, and a compensation amount of the first set value is decided according to a deviation between the second set value and the value of the fuel injection ratio of the second injector derived from the fuel injection ratio map.

In accordance with this configuration, the second set value is decreased, and as a result, the first set value is increased passively. And, the fuel injection ratio of the first injector, having been increased passively, is increased actively by compensation according to a difference between the second set value of the second injector and the value of the fuel injection ratio of the second injector which is derived from the fuel injection ratio map. Since the fuel injection amount of the first injector is increased effectively in this way, it is possible to effectively suppress the fuel supplied to the combustion chamber from becoming insufficient in amount. The above method may be used to decrease the fuel injection ratio of the second injector.

When the condition is met, the fuel injection ratio compensation section may decrease the first set value after a passage of a predetermined period such that the first set value is set to a value corresponding to a time delayed by the predetermined period.

In accordance with this configuration, the first set value is maintained at a value at a time point when the condition is met, during a period from when the condition is met until the predetermined period passes. By comparison, the fuel injection ratio of the first injector which is derived from the fuel injection ratio map decreases from the time point when the condition is met. Because of this, the first set value is increased by compensation such that the first set value is greater than the value of the fuel injection ratio of the first injector which is derived from the fuel injection ratio map, and a sum of the first set value and the second set value is increased by compensation such that this sum is greater than a sum of the fuel injection ratio of the first injector and the fuel injection ratio of the second injector which is derived from the fuel injection ratio map. Since the fuel injection amount of the first injector is increased effectively in this way, it is possible to effectively suppress the fuel supplied to the combustion chamber from becoming insufficient in amount.

When the condition is met, the fuel injection ratio compensation section may decrease the first set value after a passage of the predetermined period such that the first set value is set to a value corresponding to the time delayed by the predetermined period and set the second set value such that the second set value is less than the value of the fuel injection ratio of the second injector derived from the fuel injection ratio map.

In accordance with this configuration, the first set value is maintained at a value at a time point when the condition is met, during a period from when the condition is met until the predetermined period passes. Thereafter, the first set value is set to a value corresponding to a past time which is the predetermined period back from a current time. Since this past value is a value obtained by passively increasing the fuel injection ratio of the first injector derived from the fuel injection ratio map, by compensation, as a result of the decrease in the second set value resulting from the compensation. In the present invention, after passively increasing the fuel injection ratio of the first injector by compensation, the fuel injection ratio of the first injector is further actively increased by compensation. Since the first injection amount of the first injector is increased effectively in this way, it is possible to effectively suppress the fuel supplied to the combustion chamber from becoming insufficient in amount. The above method may be used to decrease the fuel injection ratio of the second injector.

The fuel injection ratio setting section may set the first set value and the second set value to values derived from the fuel injection ratio map, respectively, when the fuel injection ratio of the second injector read out from the fuel injection ratio map decreases in response to a decrease in a throttle valve opening degree.

In accordance with this configuration, in a case where the running state changes to a state in which the fuel injection ratio of the second injector is smaller, the fuel injection ratios are not changed by compensation, but are set to values derived from the fuel injection ratio map. This makes it possible to prevent the fuel injected from the second injector from becoming stagnant in a region upstream of a throttle valve.

The fuel injection ratio compensation section may make compensation such that the second set value is smaller than the value of the fuel injection ratio of the second injector derived from the fuel injection ratio map according to a change rate of a throttle valve opening degree, when the fuel injection ratio of the second injector derived from the fuel injection ratio map decreases in response to a decrease in the throttle valve opening degree.

In accordance with this configuration, in a case where the running state of the engine changes to a state where a high engine driving power is not necessary, for example, when deceleration starts and just after the start of the deceleration, the second set value can be changed sensitively in response to a change in the throttle valve opening degree.

The above and further objects and features of the invention will more fully be apparent from the following detailed description with reference to the accompanying drawings.

BRIEF DESCRIPTION OF THE DRAWINGS

FIG. 18 is a schematic view of a fuel-rich coefficient table stored in the memory section of FIG. 17.

FIG. 28 is a schematic view showing a deceleration fuel injection ratio map stored in a memory section of FIG. 27.

DETAILED DESCRIPTION OF THE PREFERRED EMBODIMENTS

Hereinafter, embodiments of the present embodiment will be described with reference to the drawings. A motocross type motorcycle will be described as a vehicle incorporating a fuel injection control system according to an embodiment of the present embodiment. The stated directions are referenced from a driver straddling the motorcycle. Throughout the drawings, the same or corresponding components are identified by the same reference symbols, and repetitive description will be not be given.

Embodiment 1

Motorcycle

Figure 1:
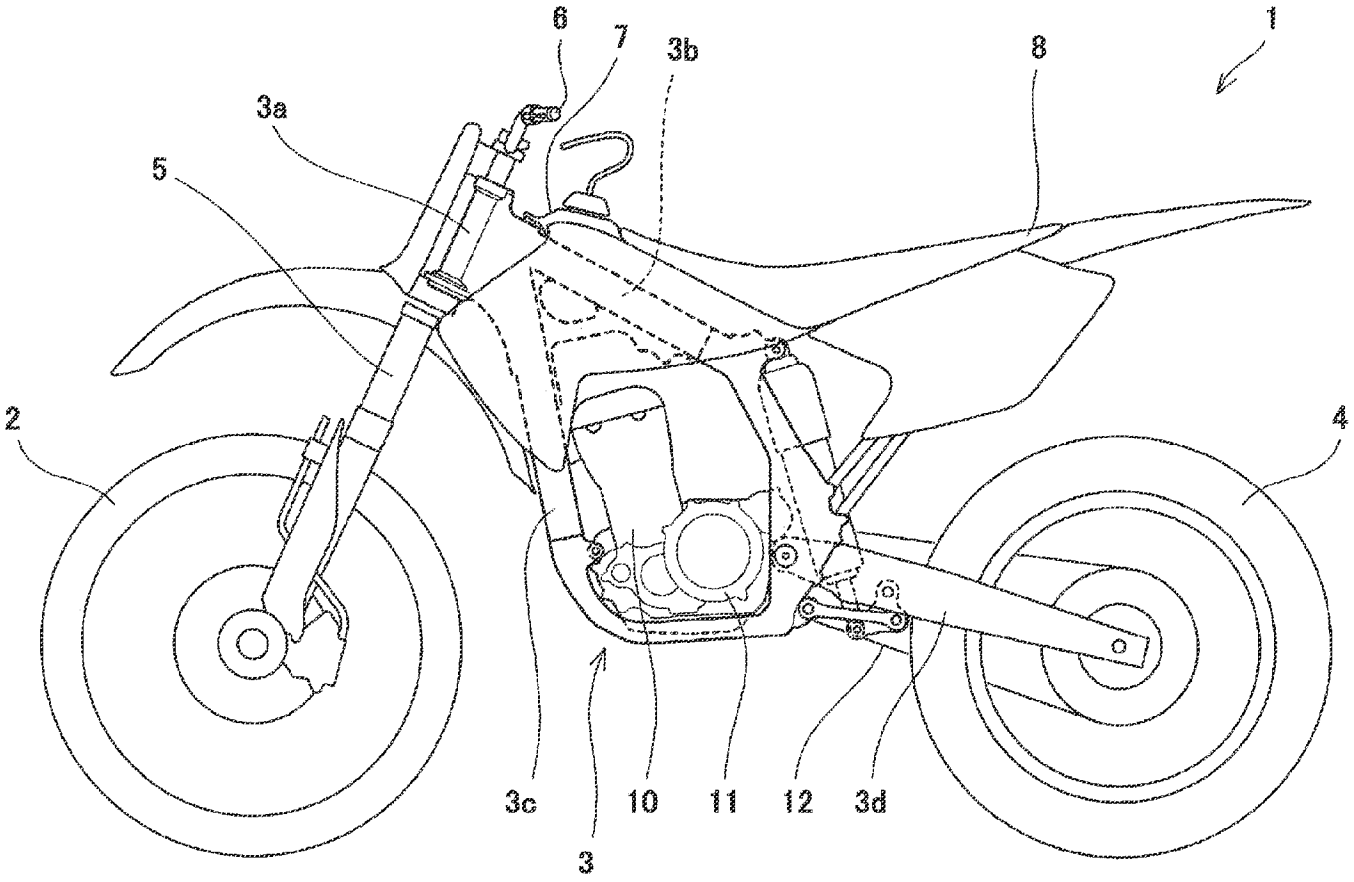
FIG. 1 is a side view of a motorcycle which is an exemplary vehicle incorporating a fuel injection control system according to Embodiment 1 of the present invention, when viewed from a left side.

FIG. 1 is a side view of a motorcycle 1 which is an exemplary vehicle incorporating a fuel injection control system according to Embodiment 1 of the present invention, when viewed from a left side. Referring to FIG. 1, the motorcycle 1 includes a front wheel 2, a vehicle body frame 3, a rear wheel 4, and an engine 10.

The front wheel 2 is rotatably mounted to a lower end portion of a front fork 5. An upper end portion of the front fork 5 is coupled to a handle 6 via a steering shaft (not shown) and brackets (not shown). The vehicle body frame 3 includes a head pipe 3*a*, a pair of right and left main frames 3*b*, a pair of right and left down frames 3*c*, and a pair of right and left swing arms 3*d*. The head pipe 3*a* supports the steering shaft such that the steering shaft is rotatable. The main frames 3*b* extend rearward from the head pipe 3*a* such that the main frames 3*b* are slightly inclined in a downward direction. The down frames 3*c* extend downward from the head pipe 3*a*, are bent, and then extend rearward. Rear end portions of the down frames 3*c* are coupled to rear end portions of the main frames 3*b*, respectively. The swing arms 3*d* extend in a forward and rearward direction. Front end portions of the swing arms 3*d* are coupled to rear end portions of the main frames 3*b*, respectively such that the swing arms 3*d* are pivotable around the front end portions. The rear wheel 4 is rotatably mounted to rear end portions of the swing arms 3*d*.

Rearward relative to the handle 6 and above the main frames 3*b*, a fuel tank 7 is disposed. Rearward relative to the fuel tank 7 and above the main frames 3*b*, a seat 8 is disposed. At a right end of the handle 6, a throttle grip 9 (see FIG. 2) is provided. The driver straddling the seat 8 can rotate the throttle grip 9 with a right hand, to change a speed and an acceleration of the motorcycle 1.

The engine 10 is placed within a space defined by the main frames 3*b* and the down frames 3*c*, when viewed from the side, and mounted to the main frames 3*b* and to the down frames 3*c*. Driving power of the engine 10 is transmitted to the rear wheel 4 via a transmission 11 and a chain 12, thereby allowing to the motorcycle 1 to drive. In the present embodiment, the engine 10 is a reciprocating four-stroke engine. The engine 10 may include a single cylinder, or multiple cylinders.

(Engine, Injector)

Figure 2:
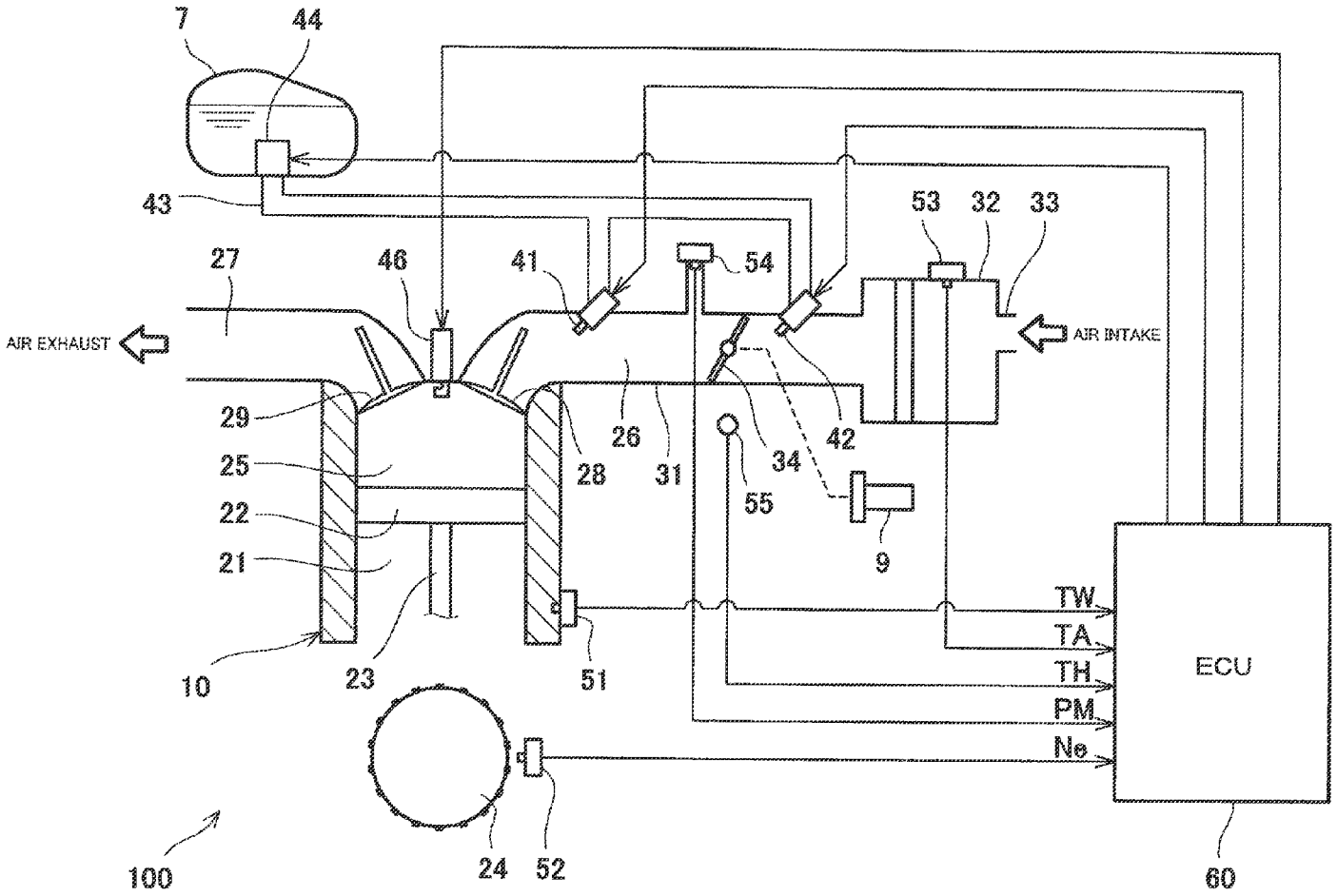
FIG. 2 is a block diagram showing a configuration of an engine of FIG. 1 and an overall configuration of the fuel injection control system of the embodiment.

FIG. 2 is a block diagram showing a configuration of a region surrounding the engine 10 of FIG. 1 and an overall configuration of a fuel injection control system 100 according to Embodiment 1 of the present invention. Referring to FIG. 2, the engine 10 includes a cylinder 21, a piston 22, a connecting rod 23, a crankshaft 24, and a combustion chamber 25. The piston 22 is reciprocatingly inserted into the cylinder 21 and coupled to the crankshaft 24 via the connecting rod 23. The combustion chamber 25 is formed at an upper surface of the piston 22. The combustion chamber 25 communicates with an air-intake passage 26 and an exhaust passage 27. The air-intake passage 26 is opened and closed by an intake valve 28, while the exhaust passage 27 is opened and closed by an exhaust valve 29. The intake valve 28 and the exhaust valve 29 are actuated by the crankshaft 24.

An air-intake pipe 31 and an air cleaner 32 are coupled to a cylinder head (not shown) of the engine 10 in this order. The air-intake passage 26 is defined by an air-intake port inside the cylinder head, an inner space of the air-intake pipe 31, and an inner space of the air cleaner 32. The air cleaner 32 has an air inlet 33 through which air is taken into the air cleaner 32 from outside. The air is supplied to the combustion chamber 25 through the air-intake passage 26. A throttle valve 34 is provided in the air-intake pipe 31. In the present embodiment, an opening degree of the throttle valve 34 (hereinafter referred to as a throttle valve opening degree) is changed mechanically or electrically according to a position of the throttle grip 9 up to which the throttle grip 9 is rotated. According to a change in the throttle valve opening degree, the amount of air supplied to the combustion chamber 25 is changed.

The engine 10 includes a first injector 41 and a second injector 42. The first injector 41 and the second injector 42 communicate with the fuel tank 7 via a fuel passage 43. Inside the fuel tank 7, a fuel pump 44 is provided. The fuel pump 44 is actuated to feed the fuel with a pressure from inside the fuel tank 7 to the first injector 41 and to the second injector 42, through the fuel passage 43. The first injector 41 and the second injector 42 are electromagnetic valves which are placed in a closed position in a normal state, and are configured to inject the fuel in a state where they are placed in an open position.

The first injector 41 and the second injector 42 are attached to the air-intake pipe 31 and are configured to inject the fuel into the inside of air-intake passage 26 from attaching positions thereof. The first injector 41 is positioned downstream of the throttle valve 34 in an air flow direction. The second injector 42 is positioned upstream of the first injector 41 in the air flow direction, and upstream of the throttle valve 34 in the air flow direction. This layout is merely exemplary. The first injector 41 may be attached to the cylinder head and may be capable of directly injecting the fuel into an inside of a cylinder, while the second injector 42 may be attached to a clean portion of the air cleaner 32. In a case where the engine 10 includes multiple cylinders, a pair of the first injector 41 and the second injector 42 may be provided to correspond to each of the multiple cylinders, or shared by the multiple cylinders.

The engine 10 goes through four strokes, which are an intake stroke, a compression stroke, an expansion (power) stroke, and an exhaust stroke. During the intake stroke, the intake valve 28 opens the air-intake passage 26, and at least one of the first injector 41 and the second injector 42 injects the fuel. Thereby, an air-fuel mixture is supplied to the combustion chamber 26 through the air-intake passage 26. The engine 10 is provided with an ignition plug 46. The ignition plug 46 generates sparks and ignites the air-fuel mixture within the combustion chamber 25. During the exhaust stroke, the exhaust valve 29 opens the exhaust passage 27. Thereby, combustion exhaust gas is exhausted from the combustion chamber 25 to the exhaust passage 27.

(Fuel Injection Control System)

The fuel injection control system 100 of the present embodiment includes the first injector 41, the second injector 42, a water temperature sensor 51, an engine speed sensor 52, an air-intake temperature sensor 53, an air-intake pressure sensor 54, a throttle position sensor 55, and an electronic control unit 60 (hereinafter referred to as the "ECU").

The water temperature sensor 51 is attached on, for example, a wall surface defining the cylinder 21 and detects a cooling water temperature TW. The engine speed sensor 52 detects a phase angle of the crankshaft 24. The ECU 60 is capable of detecting an engine speed Ne (an angular speed of the crankshaft 24) based on a signal from the engine speed sensor 52. The air-intake temperature sensor 53 is attached on the air cleaner 32, and detects a temperature TA of air taken into the air-intake passage 26. The air-intake pressure sensor 54 is attached on the air-intake pipe 31 and detects an air-intake pressure PM in a region of the air-intake passage 26 which is downstream of the throttle valve 34 in the air flow direction. The throttle position sensor 55 detects a throttle valve opening degree TH of the throttle valve 34.

The ECU 60 is constructed mainly as a microcomputer including a CPU, ROM, RAM, and an input/output interface. An input side of the ECU 60 is coupled to the above stated sensors 51 to 55. Although not shown in FIG. 2, a main power supply voltage source is coupled to the input side of the ECU 60 to control the first and second injectors 41 and 42. Alternatively, a gear position sensor, an atmospheric-pressure sensor, etc, may be coupled to the input side of the ECU 60. An output side of the ECU 60 may be coupled to the first injector 41, the second injector 42, the fuel pump 44, and the ignition plug 46. The CPU executes control programs stored in the ROM, and controls a fuel injection amount of the first injector 41 and a fuel injection amount of the second injector 42, i.e., an open period of the first injector 41 and an open period the second injector 42, operation of the fuel pump 44, and a timing of the air-intake mixture ignited by the ignition plug 46, based on running states of the engine 10 which are detected by the sensors 51 to 55. In the present embodiment, the ECU 60 controls a fuel injection ratio of the first injector 41 and a fuel injection ratio of the second injector 42 according to a change in the running states of the engine 10, to suppress the fuel supplied actually to the combustion chamber 25 from becoming insufficient in amount, even when the running states change rapidly.

(ECU)

Figure 3:
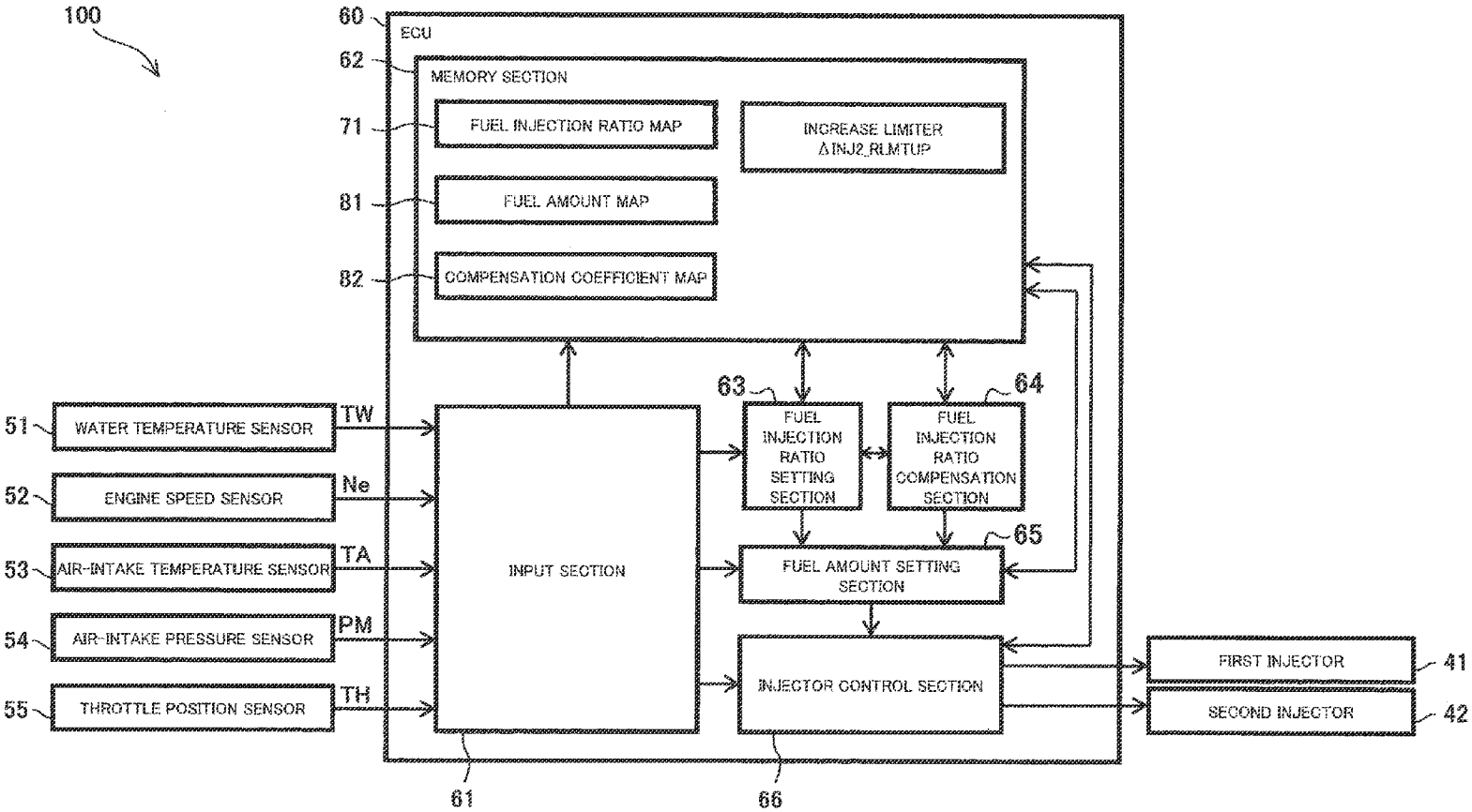
FIG. 3 is a block diagram showing a configuration of major components of the fuel injection control system according to Embodiment 1 of the present invention.

FIG. 3 is a block diagram showing a configuration of major components of the fuel injection control system 100 according to Embodiment 1 of the present invention. Referring to FIG. 3, the ECU 60 includes as functional blocks for executing the above control, the input section 61, the memory section 62, a fuel injection ratio setting section 63, a fuel injection ratio compensation section 64, a fuel amount setting section 65, and an injector control section 66.

The input section 61 receives as inputs detection signals from the sensors 51 to 55. The memory section 62 contains a fuel injection ratio map 71 used to determine a correspondence between the running states of the engine 10, and the fuel injection ratio of the first injector 41 and the fuel injection ratio of the second injector 42 with respect to a total fuel injection amount of the first injector 41 and the second injector 42. In addition, the memory section 62 contains a fuel amount map 81, a compensation coefficient map 82, and an increase limiter ΔINJ2_RLMTUP.

Figure 4:
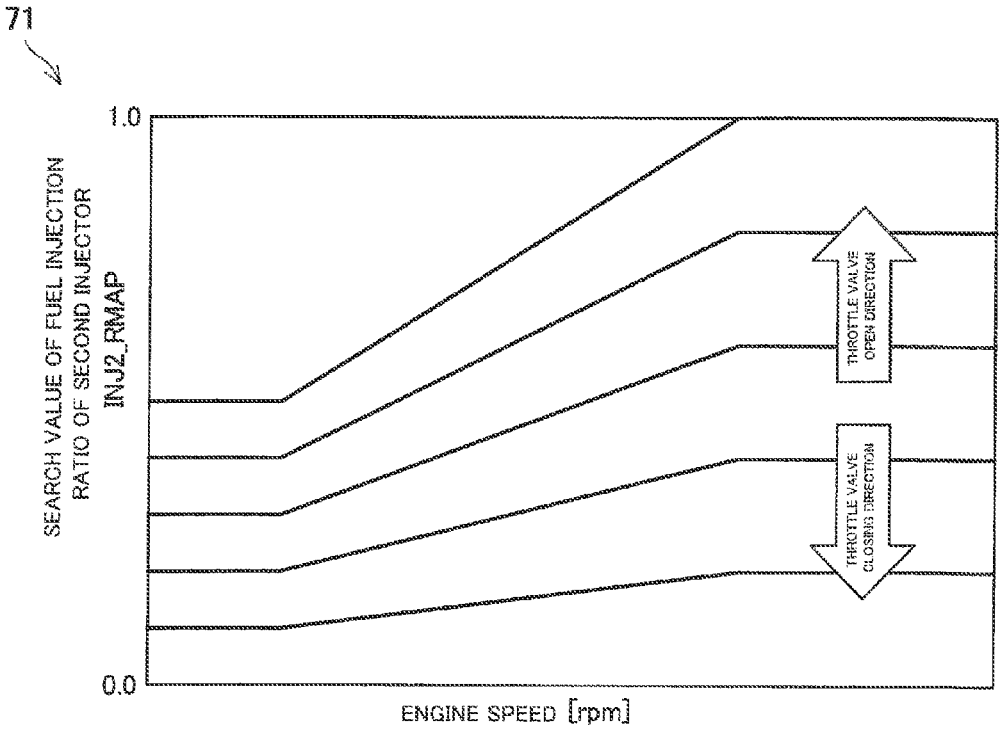
FIG. 4 is a graph schematically showing a search value calculating map stored in a memory section of FIG. 3.

FIG. 4 is a graph schematically showing the fuel injection ratio map 71 stored in the memory section 62 of FIG. 3. In FIG. 4, a horizontal axis indicates the engine speed, and a vertical axis indicates a fuel injection ratio (search value) INJ2_RMAP of the second injector 42. Among a plurality of lines depicted in an orthogonal coordinate system, an uppermost line corresponds to a running state in which the throttle valve is in a fully open position, while a lowermost line corresponds to a running state in which the throttle valve is in a fully closed position. Roughly, as the engine speed is higher and the throttle valve opening degree is greater, the search value INJ2_RMAP is greater. Thereby, when the running state corresponds to a state where the engine speed is higher and a load is higher, the fuel injection ratio of the second injector 42 is higher, thereby enabling the engine 10 to increase the engine driving power effectively by using the twin injectors.

As described above, the memory section 62 contains a single map to define a correspondence between the running state of the engine 10, and the fuel injection ratio of the first injector 41 and the fuel injection ratio of the second injector 42 with respect to the total fuel injection amount of the first injector 41 and the second injector 42. In principle, a sum of the fuel injection ratio of the first injector 41 and the fuel injection ratio of the second injector 42 is 1. When the fuel injection ratio of one of the first and second injectors 41 and 42 is decided, the fuel injection ratio of the other is derived by subtracting the fuel injection ratio of the one of the first and second fuel injectors 41 and 42, from 1. Although the fuel injection ratio map 71 is a map for defining the correspondence between the running state of the engine 10 and the fuel injection ratio of the second injector 42, the memory section 62 may contain a map for defining a correspondence between the running states of the engine 10 and the fuel injection ratio of the first injector 41. Alternatively, the memory section 62 may contain the map for deriving the fuel injection ratio of the first injector 41 and the map for deriving the fuel injection ratio of the second injector 42 individually.

Turning back to FIG. 3, the fuel injection ratio setting section 63 sets the fuel injection ratio of the first injector 41 as a first set value INJ1_RSET and the fuel injection ratio of the second injector 42 as a second set value INJ2_RSET, with reference to the fuel injection ratio map 71.

The fuel injection ratio compensation section 64 determines whether or not a condition in which the fuel injection ratio INJ2_RMAP of the second injector 42 which is read out sequentially from the fuel injection ratio map 71 is greater than a predetermined determination criterion is met. In the present embodiment, the fuel injection ratio compensation section 64 determines whether or not the fuel injection ratio INJ2_RMAP of the second injector 42 meets a condition in which its increase amount, with respect to a past value of the second set value INJ2_RSET, is greater than a predetermined threshold. The "threshold" is a value greater than zero. As described later, in the present embodiment, the fuel injection ratio compensation section 64 determines whether or not a difference between a current value of the search value INJ2_RMAP of the fuel injection ratio of the second injector 42 and a previous value of the second set value INJ2_RSET, is not less than the increase limiter ΔINJ2_RLMTUP stored in the memory section 62. If this condition is met, the fuel injection ratio compensation section 64 makes compensation so that the first set value INJ1_RSET is greater than a fuel injection ratio (1−INJ2_RMAP) of the first injector 41 which is derived from the fuel injection ratio map 71.

The fuel amount setting section 65 derives a base fuel amount TIMAP with reference to the fuel amount map 81 stored in the memory section 62. The fuel amount setting section 65 derives a compensation coefficient MTOTAL with reference to the compensation coefficient map 82 stored in the memory section 62. The fuel amount map 81 is one type of a total fuel injection amount map for defining a correspondence between the running state of the engine 10 and the total injection amount of the first injector 41 and the second injector 42. The base fuel amount TIMAP is a base value of the total injection amount TTOTALOUT of the first injector 41 and the second injector 42, and is calculated based on an engine speed and a throttle valve opening degree with reference to a correspondence defined in the fuel amount map 81. The base fuel amount TIMAP is a greater value as the engine speed is higher and the throttle valve opening degree is greater. The compensation coefficient MTOTAL is calculated based on a water temperature, an air-intake temperature, an air-intake pressure, an atmospheric pressure, etc., and is used to make compensation for the base fuel amount TIMAP. The base fuel amount TIMAP and the compensation coefficient MTOTAL may be calculated based on, for example, a transmission gear position.

The fuel amount setting section 65 sets a command value T1OUT (hereinafter referred to as "first fuel amount command value") of the fuel injection amount (open period of the first injector 41) of the first injector 41 based on the base fuel amount TIMAP, the compensation coefficient MTOTAL, the first set value INJ1_RSET, etc. The fuel amount setting section 65 sets a command value T2OUT (hereinafter referred to as "second fuel amount command value") of the fuel injection amount (open period of the second injector 42) of the second injector 42 based on the base fuel amount TIMAP, the compensation coefficient MTOTAL, the second set value INJ2_RSET, etc.

The injector control section 66 controls the first injector 41 so that the fuel is injected from the first injector 41 with the fuel amount indicated by the first fuel injection amount command value T1OUT set based on the first set value INJ1_RSET. The injector control section 66 controls the second injector 42 so that the fuel is injected from the second injector 42 with the fuel amount indicated by the second fuel injection amount command value T2OUT set based on the second set value INJ2_RSET. The injector control section 66 controls the open periods and closed periods of the injectors 41 and 42 with reference to the phase angle of the crankshaft 24 detected by the engine speed sensor 52, the fuel injection timing map (not shown) set in the memory section 62, etc.

(Fuel Amount Setting Process)

Figure 5:
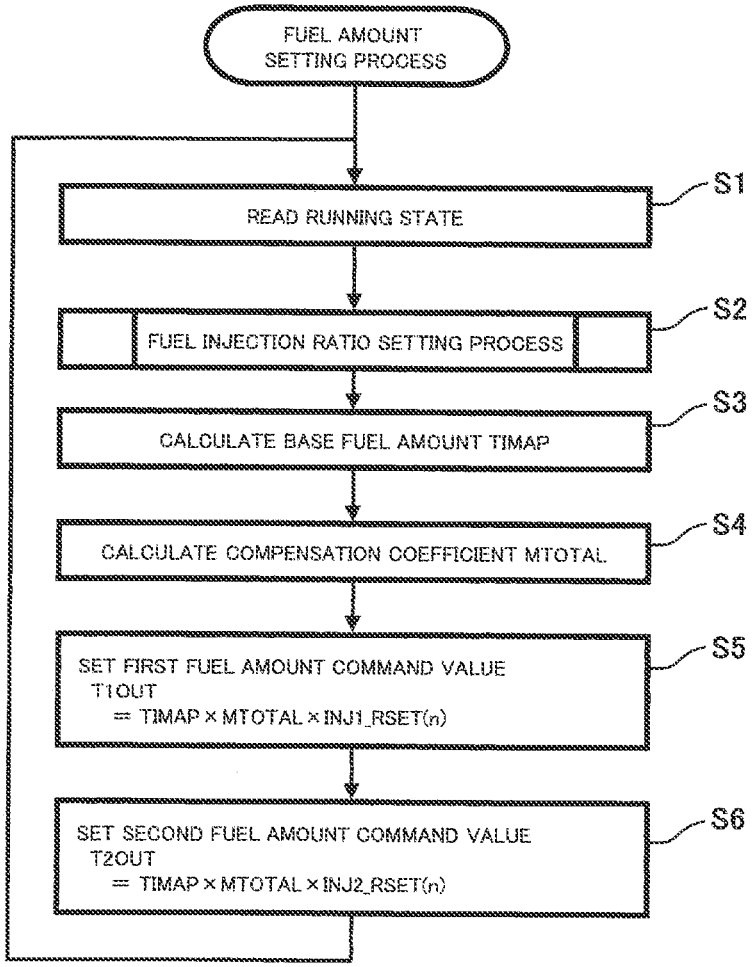
FIG. 5 is a flowchart showing a fuel amount setting process executed by the ECU of FIG. 3.

FIG. 5 is a flowchart showing the fuel amount setting process executed by the ECU 60 of FIG. 3. The process shown in FIG. 5 is a routine run to sequentially set a first fuel amount command value T1OUT and a second fuel amount command value T2OUT fed to the injector control section 66, and is repeated at least every one engine cycle. Hereinafter, a subscript (n) indicates a current value, and a subscript (n−1) indicates a past value (hereinafter referred to as "previous value") calculated or set in the past which is one cycle back from the current value. No subscripts may be assigned to the values extracted at time points which need not be considered.

The running states of the engine 10 detected by the sensors 51~55 are read (step S1). Then, the fuel injection ratio setting section 63 and the fuel injection ratio compensation section 64 perform the fuel injection ratio setting process (step S2) as described later in detail, and set a current value INJ1_RSET (n) of the first set value, and a current value INJ2_RSET(n) of the second set value. The fuel amount setting section 65 calculates the base fuel amount TIMAP (step S3) and calculates the compensation coefficient MTOTAL (step S4).

Then, the fuel amount setting section 65 sets the first fuel amount command value TIOUT using a formula (1) (step S5), and sets the second fuel amount command value T2OUT using a formula (2) (step S6):

$$T1\mathrm{OUT}=TI\mathrm{MAP}\times M\mathrm{TOTAL}\times INJ1__R\mathrm{SET}(n) \quad (1)$$

$$T2\mathrm{OUT}=TI\mathrm{MAP}\times M\mathrm{TOTAL}\times INJ2__R\mathrm{SET}(n) \quad (2)$$

The first fuel amount command value TIOUT is derived by multiplying a value (TIMAP×MTOTAL) obtained by making compensation for the base fuel amount TIMAP using the compensation coefficient MTOTAL, by the current value INJ1_RSET(n) of the first set value. The second fuel amount command value T2OUT is derived by multiplying the compensated value (TIMAP×MTOTAL) by the current value INJ2_RSET(n) of the second set value. A total fuel injection amount TTOTALOUT of the first injector 41 and the second injector 42 is a sum of the first fuel amount command value TIOUT and the second fuel injection amount command value T2OUT as represented by a formula (3).

$$T\mathrm{TOTALOUT}=T1\mathrm{OUT}+T2\mathrm{OUT}$$

$$(=TI\mathrm{MAP}\times M\mathrm{TOTAL}\times(INJ1__R\mathrm{SET}(n)+INJ2__R\mathrm{SET}(n))) \quad (3)$$

In the present embodiment, the sum of the current value INJ1_RSET(n) of the first set value and the current value INJ2_RSET(n) of the second set value is 1. Because of this, the fuel injection amount TTOTALOUT is the compensated value (TIMAP×MTOTAL).

(Fuel Injection Ratio Setting Process)

Figure 6:
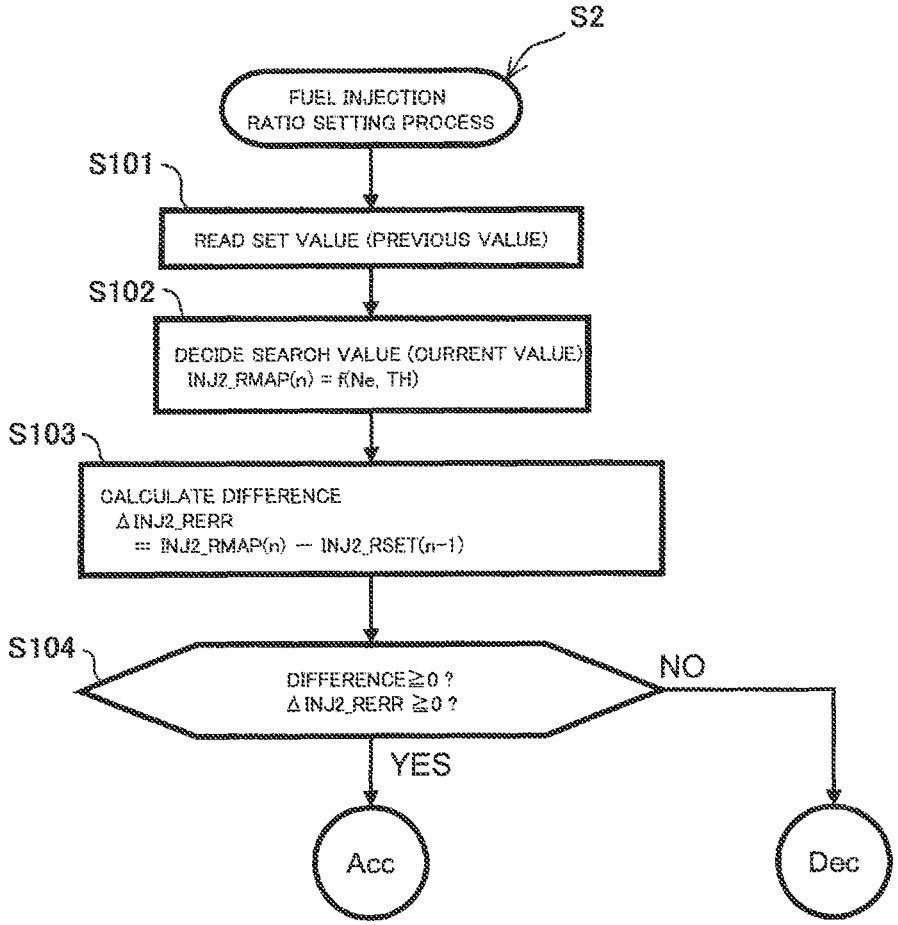
FIG. 6 is a flowchart showing a part of the fuel injection ratio setting process of FIG. 5.
Figure 7:
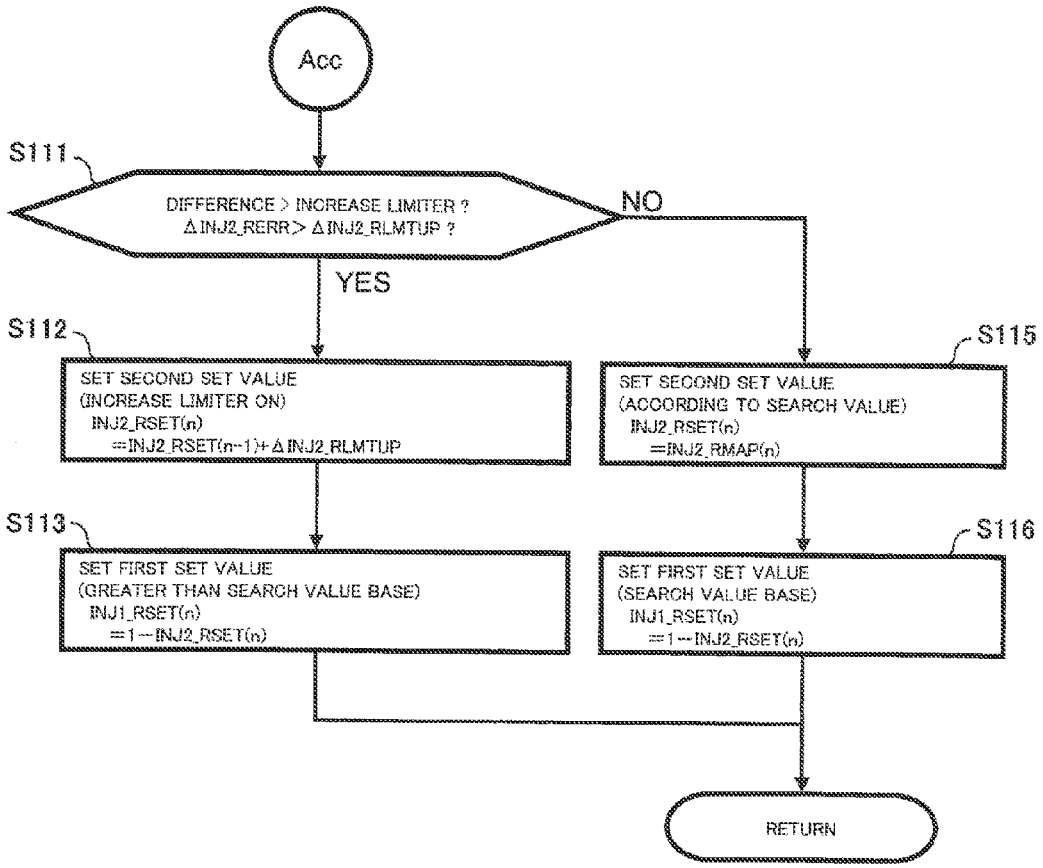
FIG. 7 is a flowchart showing a part of the fuel injection ratio setting process of FIG. 5.
Figure 8:
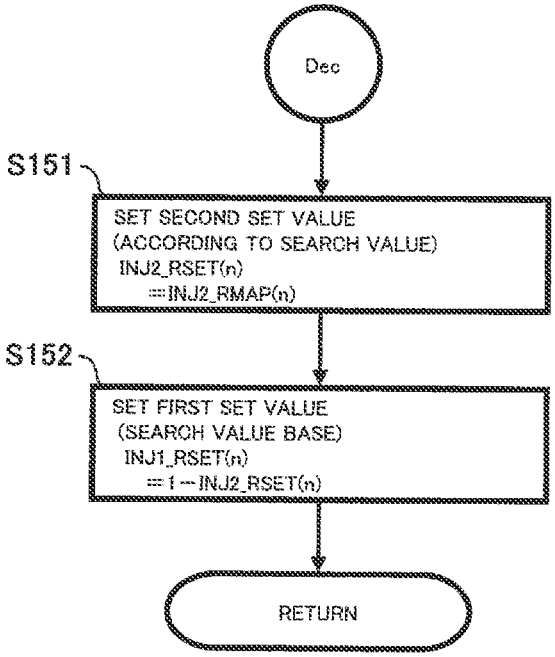
FIG. 8 is a flowchart showing a part of the fuel injection ratio setting process of FIG. 5.

FIGS. 6 to 8 are flowcharts, each showing a part of the fuel injection ratio setting process (S2) of FIG. 5. In the fuel injection ratio setting process (S2), the search value INJ2_RMAP is derived at least every one engine cycle.

Referring to FIG. 6, a previous value INJ2_RSET(n−1) of the second set value is read (step S101). The fuel injection ratio setting section 63 calculates a current value INJ2_RMAP (n) of the search value (step S102). The search value INJ2_RMAP is calculated based on an engine speed Ne and a throttle valve opening degree TH with reference to a correspondence defined in the fuel injection ratio map 71. Then, the fuel injection ratio setting section 63 calculates a difference ΔINJ2_RERR between the current value INJ2_RMAP (n) of the search value and the previous value INJ2_RSET(n−1) of the second set value (step S103).

$$\Delta INJ2__RERR=INJ2__R\mathrm{MAP}(n)-INJ2__R\mathrm{SET}(n-1) \quad (4)$$

As can be seen from the formula (4), the difference ΔINJ2_RERR is derived by subtracting the previous value INJ2_RSET(n−1) of the second set value from the current value INJ2_RMAP (n) of the search value. Roughly, the search value INJ2_RMAP increases as the engine speed Ne increases and the throttle valve opening degree TH increases (see FIG. 4). Because of this, just after the motorcycle 1 has shifted from cruising to accelerated driving, the difference ΔINJ2_RERR is a positive value, while just after the motorcycle 1 has shifted from cruising to decelerated driving, the difference ΔINJ2_RERR is a negative value. When a change in the running states of the engine 10 is small, for example, during cruising, the difference ΔINJ2_RERR is zero. Then, the fuel injection ratio setting section 63 determines whether or not the difference ΔINJ2_RERR is greater than or equal to zero (i.e., not less than zero) (step S104). In other words, the fuel injection ratio setting section 63 determines whether or not the current value INJ2_RMAP (n) of the search value is not less than the previous value INJ2_RSET(n−1) of the second set value. If it is determined that the difference ΔINJ2_RERR is greater than or equal to zero (i.e. is not less than zero) (S104: YES), the process goes to the process shown in FIG. 7, while if it is determined that the difference ΔINJ2_RERR is less than zero (S104: NO), the process goes to the process shown in FIG. 8.

(Setting of Fuel Injection Ratio During Acceleration, Etc.)

Referring to FIG. 7, if it is determined that the difference ΔINJ2_RERR is not less than zero (S104: YES), the fuel injection ratio compensation section 64 determines whether or not the difference ΔINJ2_RERR is greater than the increase limiter ΔINJ2_RLMTUP (step S111). The increase limiter ΔINJ2_RLMTUP functions as a threshold used to determine whether or not an increase amount (increase rate) of the second set value INJ2_RSET should be limited when the search value INJ2_RMAP increases according to a change in the running states, and functions as the increase amount (increase rate) of the second set value INJ2_RSET to limit the increase amount (increase rate).

If it is determined that the difference ΔINJ2_RERR is greater than the increase limiter ΔINJ2_RLMTUP (step S111: YES), the fuel injection ratio compensation section 64 sets the current value INJ2_RSET(n) of the second set value using a formula (5) (step S112), and sets the current value INJ1_RSET(n) of the first set value using a formula (6) (step S113).

$$INJ2_RSET(n)=INJ2_RSET(n-1)+\Delta INJ2_RLMTUP$$

$$(<INJ2_RSET(n-1)+\Delta INJ2_RERR=INJ2_RMAP(n)) \quad (5)$$

$$INJ1_RSET(n)=1-INJ2_RSET(n)$$

$$(>1-INJ2_RMAP(n)) \quad (6)$$

The current value INJ2_RSET(n) of the second set value is set to a value obtained by adding the increase limiter ΔINJ2_RLMTUP to the previous value INJ2_RSET(n−1) of the second set value. Since the increase limiter ΔINJ2_RLMTUP is less than the difference ΔINJ2_RERR, the current value INJ2_RSET(n) of the second set value is set to a value less than the current value INJ2_RMAP (n) of the search value. The current value INJ1_RSET(n) of the first set value is set to a value obtained by subtracting the current value INJ2_RSET(n) of the second set value from 1. Since the current value INJ2_RSET(n) of the second set value is less than the current value INJ2_RMAP (n) of the search value, the current value INJ1_RSET(n) of the first set value is set to a value greater than the value (1−INJ2_RMAP(n)) derived from the fuel injection ratio map 71. When setting of the current value INJ1_RSET(n) of the first set value and the current value INJ2_RSET(n) of the second set value is completed, the process returns to the fuel amount setting process of FIG. 5 (The same occurs hereinafter).

If it is determined that the difference ΔINJ2_RERR is not greater than the increase limiter ΔINJ2_RLMTUP (step S111: NO), the fuel injection ratio setting section 63 sets the current value INJ2_RSET(n) of the second set value using a formula (7) (step S115), and sets the current value INJ1_RSET(n) of the first set value using a formula (8) (step S116):

$$\text{i. } INJ2_RSET(n)=INJ2_RMAP(n) \quad (7)$$

$$\text{ii. } INJ1_RSET(n)=1-INJ2_RSET(n) \quad (8)$$

$$1.\ (=1-INJ2_RMAP(n))$$

The current value INJ2_RSET(n) of the second set value is the current value INJ2_RMAP (n) of the search value which is derived from the fuel injection ratio map 71. Therefore, differently from the case where the increase limiter is active, the current value INJ1_RSET(n) of the first set value is equal to a value obtained by subtracting the current value INJ2_RMAP (n) of the search value from 1, i.e., a fuel injection ratio of the first injector 41 derived from the fuel injection ratio map 71.

(Setting of Fuel Injection Ratio During Deceleration, Etc.)

Referring to FIG. 8, if it is determined that the difference ΔINJ2_RERR is less than zero, the fuel injection ratio setting section 63 sets the current value INJ2_RSET(n) of the second set value using the formula (7) (step S151), and sets the current value INJ1_RSET(n) of the first set value using the formula (8) (step S152). That is, immediately after the motorcycle 1 has shifted to decelerated driving, etc., the current value INJ1_RSET(n) of the first set value and the current value INJ2_RSET(n) of the second set value are set to values derived from the fuel injection ratio map 71, irrespective of a decrease amount or decrease rate of the search value.

(Change in Fuel Injection Ratio which Occurs with Time)

Figure 9:
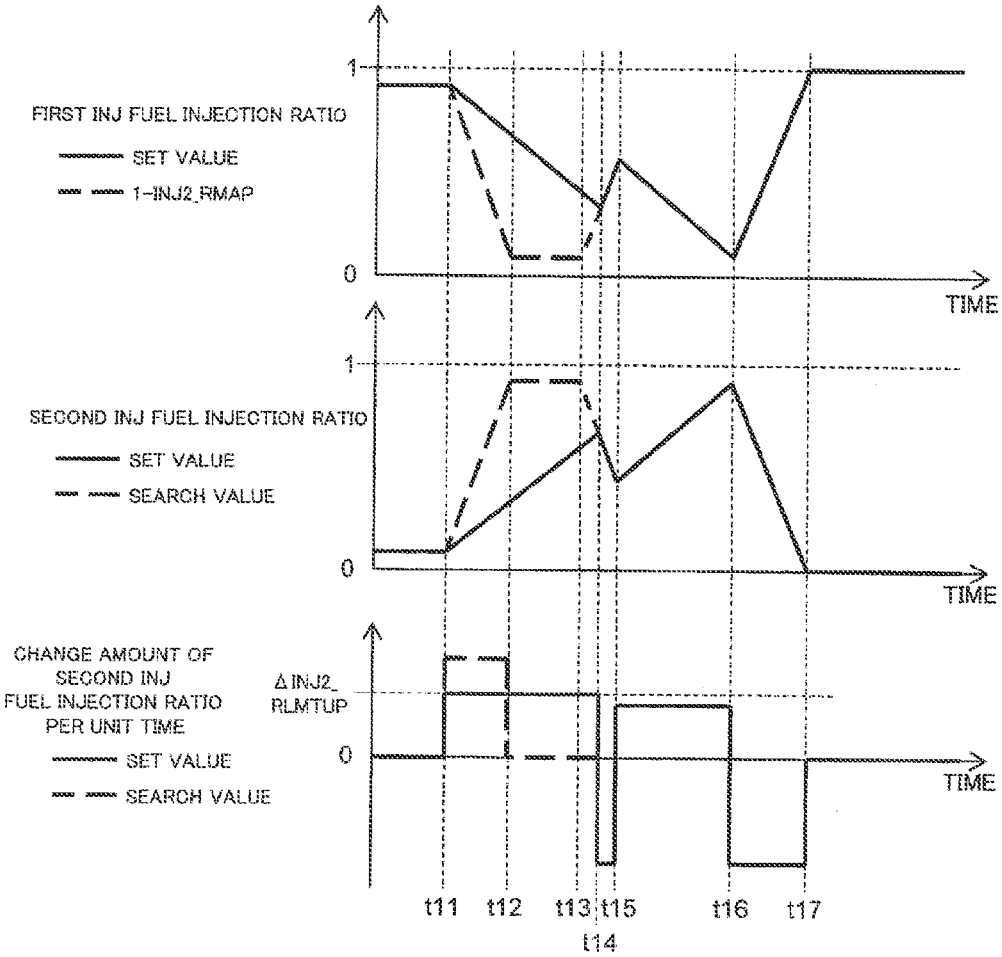
FIG. 9 is a time chart showing an exemplary time change in a fuel injection ratio of a first injector and an exemplary time change in a fuel injection ratio of a second injector in a case where the fuel injection ratio setting process shown in FIGS. 6 to 8 is performed.

FIG. 9 is a time chart showing an exemplary time change in the fuel injection ratio of the first injector 41 and an exemplary time change in the fuel injection ratio of the second injector 42 in a case where the fuel injection ratio setting process (S2) shown in FIGS. 6 to 8 is performed.

For example, when the driver rotates the throttle grip 9 to an open position and the running state of the engine changes rapidly to a state corresponding to a high engine speed range, the search value INJ2_RMAP rapidly increases (t11 to t12). At t11 when the search value INJ2_RMAP starts increasing rapidly, the difference ΔINJ2_RERR is not less than zero. If the difference ΔINJ2_RERR exceeds the increase limiter ΔINJ2_RLMTUP, the second set value INJ2_RSET increases gradually with an increase rate defined by the increase limiter ΔINJ2_RLMTUP. The first set value INJ1_RSET decreases gradually with a small change rate, and continues to be set to a value greater than the fuel injection ratio (1−INJ2_RMAP) of the first injector 41 which is derived from the fuel injection ratio map 71.

As described above, if the running state changes rapidly to the state corresponding to the high engine speed range and the search value INJ2_RMAP changes rapidly, the increase in the fuel injection ratio of the second injector 42 is limited, and the fuel injection ratio of the first injector 41 is increased passively by compensation to make up for the limited fuel injection ratio of the second injector 42. This allows the fuel injected from the first injector 41 to make up for the fuel which is injected from the second injector 42 and reaches the combustion chamber 25 at a retarded timing, i.e., cannot reach the combustion chamber 25 at a desired timing, due to the layout of the second injector 42. Since the first injector 41 is positioned closer to the combustion chamber 25, the fuel injected from the first injector 41 reaches the combustion chamber 25 promptly. Therefore, the fuel supplied to the combustion chamber 25 can be prevented from becoming insufficient in amount.

When the running state stops changing, the search value INJ2_RMAP stops increasing (t12). FIG. 9 shows a case where the search value decreases (t13~t15) after a change amount of the search value per unit time is changing near zero (t12~t13). If the increase limiter ΔINJ2_RLMTUP continues to be activated from when the running state starts changing until it stops changing, a difference between the search value INJ2_RMAP and the second set value INJ2_RSET occurs at t12 when the running state stops changing. In the present embodiment, in a period when the difference ΔINJ2_RERR is not less than the increase limiter ΔINJ2_RLMTUP, even if the search value INJ2_RMAP increases a little or changes from increasing to decreasing, the second set value INJ2_RSET continues to increase with an increase rate defined by the increase limiter ΔINJ2_RLMTUP (t12~t14). Therefore, it is possible to suppress the fuel injection ratio from changing rapidly just after the running state stops changing. When the difference ΔINJ2_RERR becomes less than the increase limiter ΔINJ2_RLMTUP (i.e., the second set value INJ2_RSET catches up with the search value INJ2_RMAP), the second set value INJ2_RSET is set to the search value INJ2_RMAP (t14 t15).

Even when the driver rotates the throttle grip 9 to an open position and the running state of the engine starts changing to a state corresponding to a high engine speed range, the second set value INJ2_RSET is set to the search value INJ2_RMAP so long as the difference ΔINJ2_RERR is a small value less than the increase limiter ΔINJ2_RLMTUP (t15~t16).

For example, when the driver rotates the throttle grip 9 to an closed position and the running state of the engine starts changing to a state corresponding to a low engine speed range, the search value INJ2_RMAP starts decreasing according to this change (t16~t17). During this time, the first set value INJ1_RSET and the second set value INJ2_RSET are set to the values derived from the fuel injection ratio map 71 irrespective of the magnitude of the difference ΔINJ2_RERR. By setting the first and second set values to the values read from the fuel injection ratio map 71, i.e., according to the search values in this way, the fuel injection ratio can be changed by reflecting the change in the running states, and it is possible to suppress the fuel injected from the second injector 42 from becoming stagnant in the air-intake passage 26 without reaching the combustion chamber 25.

Embodiment 2

Figure 10:
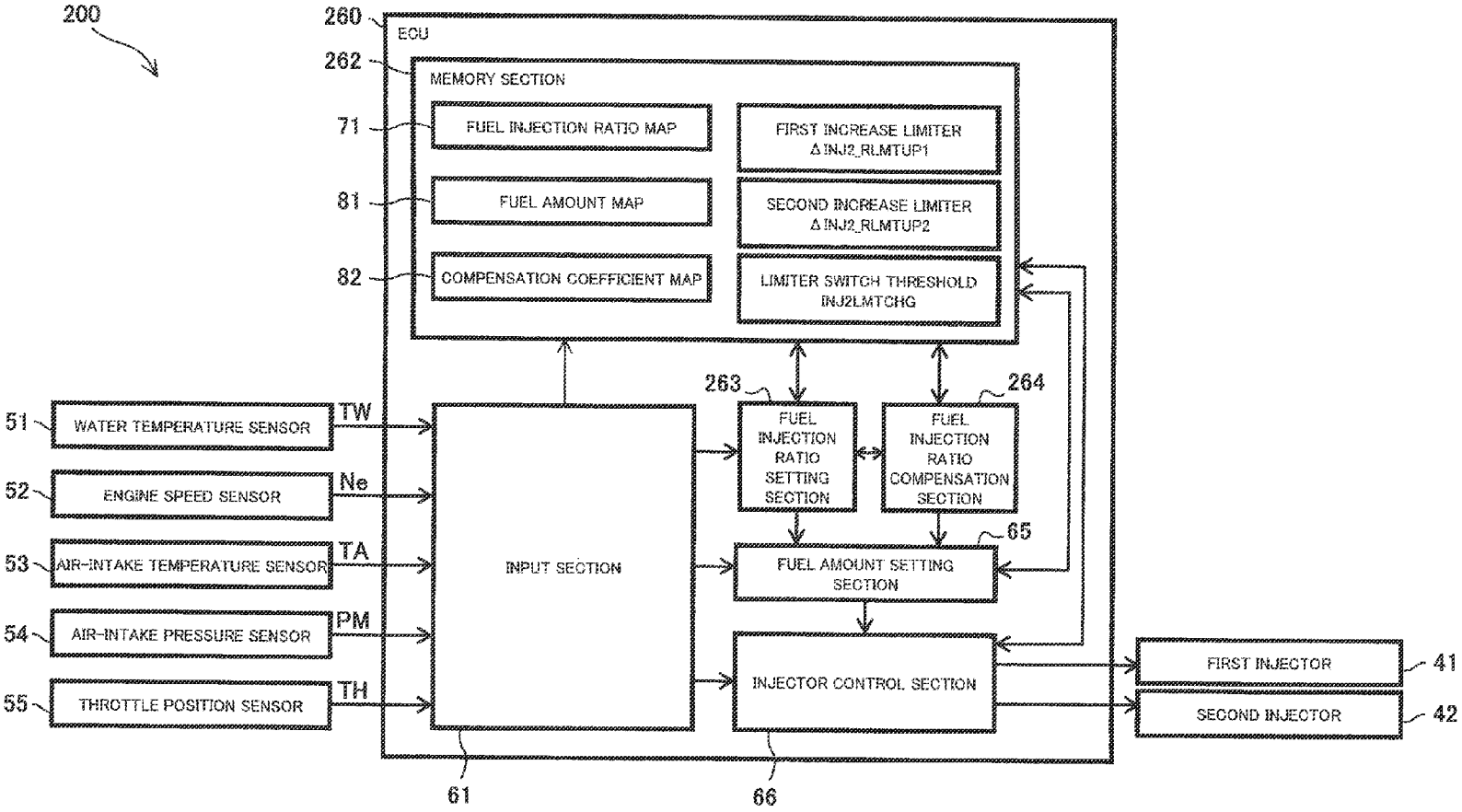
FIG. 10 is a block diagram showing a configuration of major components of a fuel injection control system according to Embodiment 2 of the present invention.
Figure 11:
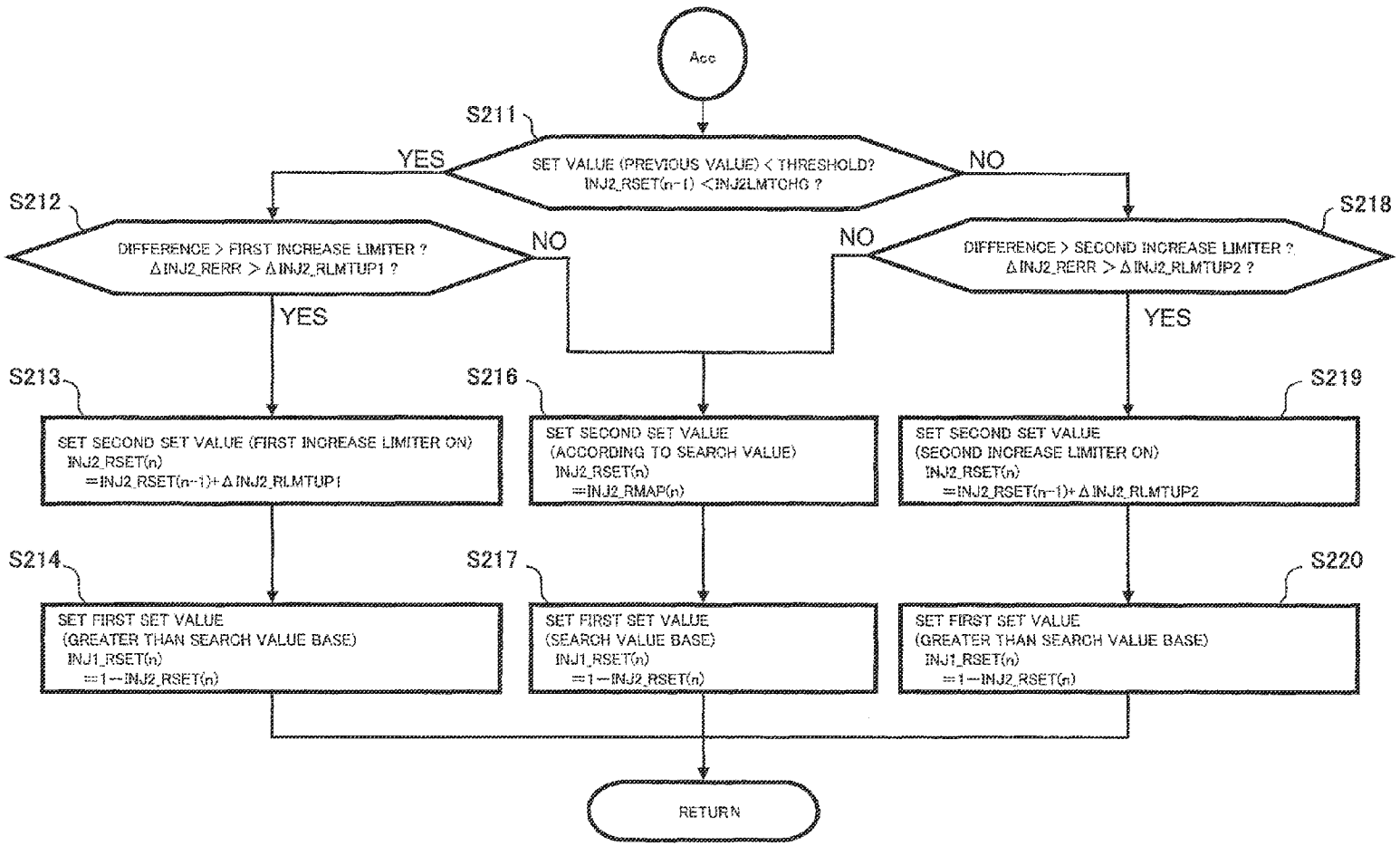
FIG. 11 is a flowchart showing a part of the fuel injection ratio setting process executed by the ECU of FIG. 10.

FIG. 10 is a block diagram showing a configuration of major components of a fuel injection control system 200 according to Embodiment 2 of the present invention. FIG. 11 is a flowchart showing a part of a fuel injection ratio setting process executed by the ECU 260 of FIG. 10. Hereinafter, the fuel injection control system 200 of Embodiment 2 will be described, mainly regarding differences with the fuel injection control system 100 of Embodiment 1.

(ECU)

Referring to FIG. 10, in the present embodiment, a memory section 262 contains the fuel injection ratio map 71, the fuel amount map 81 and the compensation coefficient map 82 as in Embodiment 1. In addition, the memory section 262 contains a first increase limiter ΔINJ2_RLMTUP1, a second increase limiter ΔINJ2_RLMTUP2, and a limiter switch threshold INJ2LMTCHG. The first increase limiter ΔINJ2_RLMTUP1 is smaller in value than the second increase limiter ΔINJ2_RLMTUP2.

A fuel injection ratio setting section 263 and a fuel injection ratio compensation section 264 use the first increase limiter ΔINJ2_RLMTUP1, the second increase limiter ΔINJ2_RLMTUP2, and the limiter switch threshold INJ2LMTCHG in the process for setting the current value INJ1_RSET(n) of the first set value and the current value INJ2_RSET(n) of the second set value, in a case where the difference ΔINJ2_RERR is not less than zero. An ECU 260 performs the process shown in FIGS. 6 and 8, as in Embodiment 1, and performs a process shown in FIG. 11 instead of the process shown in FIG. 7.

(Setting of Fuel Injection Ratio During Acceleration, Etc.)

Referring to FIG. 11, if it is determined that the difference is not less than zero, the fuel injection ratio setting section 263 determines whether or not a previous value INJ2_RSET(n−1) of the second set value is less than the limiter switch threshold INJ2LMTCHG (step S211). If it is determined that the previous value INJ2_RSET(n−1) of the second set value is less than the limiter switch threshold INJ2LMTCHG (step S211: YES), the fuel injection ratio compensation section 264 determines whether or not the difference ΔINJ2_RERR is greater than the first increase limiter ΔINJ2_RLMTUP1 (step S212). If it is determined that the difference ΔINJ2_RERR is greater than the first increase limiter ΔINJ2_RLMTUP1 (step S212: YES), the fuel injection ratio compensation section 264 sets the current value INJ2_RSET(n) of the second set value using a formula (5a) (step S213) and sets the current value INJ1_RSET(n) of the first set value using a formula (6a) (step S214).

$$INJ2_RSET(n)=INJ2_RSET(n-1)+\Delta INJ2_RLMTUP1$$

$$(<INJ2_RSET(n-1)+\Delta INJ2_RERR=INJ2_RMAP(n)) \quad (5a)$$

$$INJ1_RSET(n)=1-INJ2_RSET(n)$$

$$(>1-INJ2_RMAP(n)) \quad (6a)$$

In the formula (5a), an addition term of the increase limiter ΔINJ2_RLMTUP in a right side of the formula (5) is changed into an addition term of the first increase limiter ΔINJ2_RLMTUP1. The current value INJ2_RSET(n) of the second set value is set to a value obtained by adding the first increase limiter ΔINJ2_RLMTUP1 to the previous value INJ2_RSET(n−1) of the second set value. The formula (6a) is identical to the formula (6) of Embodiment 1. The current value INJ1_RSET(n) of the first set value is set to a value obtained by subtracting the current value INJ2_RSET(n) of the second set value from 1. In this case, the current value INJ2_RSET(n) of the second set value is also set to a value less than the current value INJ2_RMAP (n) of the search value which is derived from the fuel injection ratio map 71. The current value INJ1_RSET(n) of the first set value is set to a value greater than the fuel injection ratio (1−INJ2_RMAP (n)) of the first injector 41 which is derived from the fuel injection ratio map 71.

If it is determined that the difference ΔINJ2_RERR is not greater than the first increase limiter ΔINJ2_RLMTUP1 (step S212: NO), the fuel injection ratio setting section 263 sets the current value INJ2_RSET(n) of the second set value using a formula (7) (step S216) and sets the current value INJ1_RSET(n) of the first set value using a formula (8) (step S217).

If it is determined that the previous value INJ2_RSET(n−1) of the second set value is not less than the limiter switch threshold INJ2LMTCHG (step S211: NO), the fuel injection ratio compensation section 264 determines whether or not the difference ΔINJ2_RERR is greater than the second increase limiter ΔINJ2_RLMTUP2 (step S218). If it is determined that the difference ΔINJ2_RERR is greater than the second increase limiter ΔINJ2_RLMTUP2 (step S218: YES), the fuel injection ratio compensation section 264 sets the current value INJ2_RSET(n) of the second set value using a formula (5b) (step S219), and sets the current value INJ1_RSET(n) of the first set value using a formula (6b) (step S220).

$$INJ2_RSET(n)=INJ2_RSET(n-1)+\Delta INJ2_RLMTUP2$$

$$(<INJ2_RSET(n-1)+\Delta INJ2_RERR=INJ2_RMAP(n)) \quad (5b)$$

$$INJ1_RSET(n)=1-INJ2_RSET(n)$$

$$(>1-INJ2_RMAP(n)) \quad (6b)$$

In the formula (5a), an addition term of the increase limiter ΔINJ2_RLMTUP in a right side of the formula (5) is changed into an addition term of the second increase limiter ΔINJ2_RLMTUP2. The current value INJ2_RSET(n) of the second set value is set to a value obtained by adding the second increase limiter ΔINJ2_RLMTUP2 to the previous value INJ2_RSET(n−1) of the second set value. The formula (6b) is identical to the formula (6) of Embodiment 1. The current value INJ1_RSET(n) of the first set value is set to a value obtained by subtracting the current value INJ2_RSET (n) of the second set value from 1. In this case, the current value INJ2_RSET(n) of the second set value is also set to a value less than the current value INJ2_RMAP (n) of the search value which is derived from the fuel injection ratio map 71. The current value INJ1_RSET(n) of the first set value is set to a value greater than the fuel injection ratio (1−INJ2_RMAP(n)) of the first injector 41 which is derived from the fuel injection ratio map 71.

If it is determined that the difference ΔINJ2_RERR is not greater than the second increase limiter ΔINJ2_RLMTUP2 (step S218: NO), the fuel injection ratio setting section 263 sets the current value INJ2_RSET(n) of the second set value (step S216), and sets the current value INJ1_RSET(n) of the first set value (step S217).

(Change in Fuel Injection Ratio which Occurs with Time)

Figure 12:
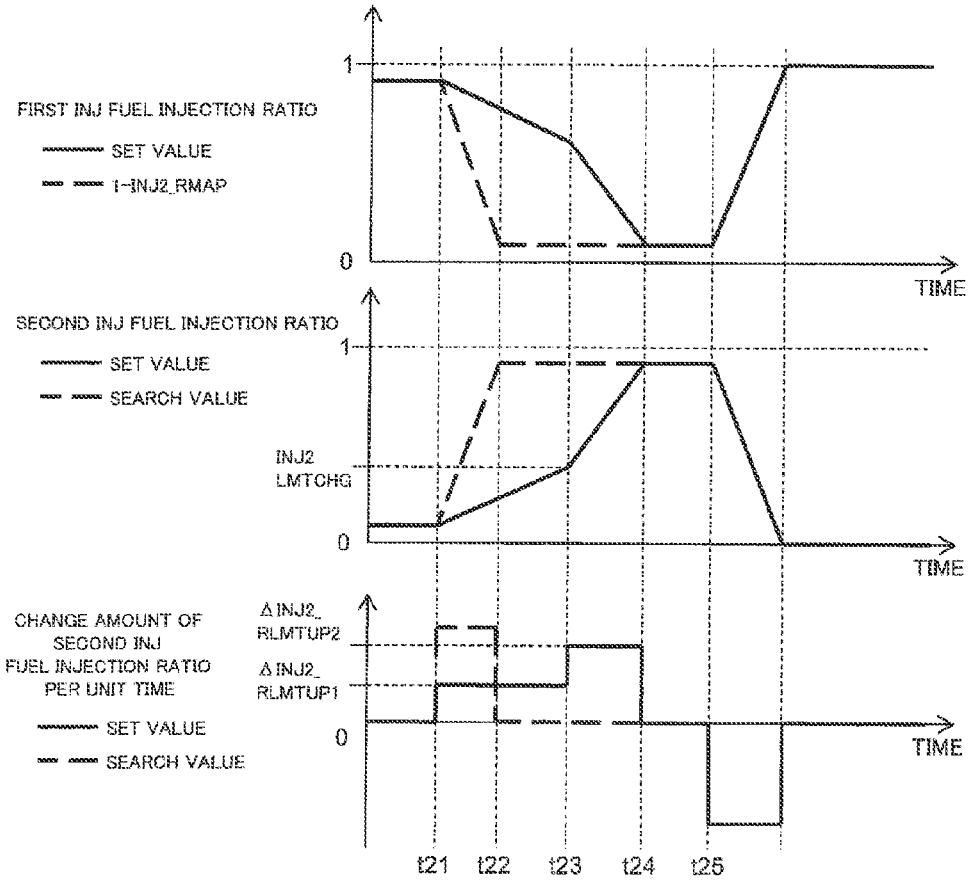
FIG. 12 is a time chart showing an exemplary time change in the fuel injection ratio of the first injector and an exemplary time change in the fuel injection ratio of the second injector in a case where the fuel injection ratio setting process shown in FIGS. 6, 8 and 11 is performed.

FIG. 12 is a time chart showing an exemplary time change in a fuel injection ratio of the first injector 41 and an exemplary time change in a fuel injection ratio of the second injector 42 in a case where the fuel injection ratio setting process shown in FIGS. 6, 8 and 11 is performed. Referring to FIG. 12, the search value INJ2_RMAP increases rapidly according to a change in the running state (t21~t22). It is assumed that at a time point when the search value INJ2_RMAP starts increasing, the second set value INJ2_RSET is less than the limiter switch threshold INJ2LMTCHG, and an increase rate of the search value INJ2_RMAP is greater than an increase rate defined by the first increase limiter ΔINJ2_RLMTUP1 and an increase rate of the second increase limiter ΔINJ2_RLMTUP2. The change in the values just after start of deceleration (after t25) is the same as that after t16 in Embodiment 1, and description thereof is omitted.

In this case, when the search value INJ2_RMAP starts increasing, the second set value INJ2_RSET is set to a value different from the search value, but increases gradually with the increase rate defined by the first increase limiter ΔINJ2_RLMTUP1 (t21~t23). The first set value INJ1_RSET decreases with a gradual change rate. At t22 when the search value INJ2_RMAP stops increasing, the second set value INJ2_RSET is less than the limiter switch threshold INJ2LMTCHG. Because of this, after t22, the second set value INJ2_RSET continues to increase gradually with the increase rate defined by the first increase limiter ΔINJ2_RLMTUP1, and gradually makes up for a difference with the search value INJ2_RMAP (t21~t23). At t23 when the second set value INJ2_RSET has reached the limiter switch threshold INJ2LMTCHG, a limiter for limiting an increase in the second set value INJ2_RSET switches from the first increase limiter ΔINJ2_RLMTUP1 to the second increase limiter ΔINJ2 RLMTUP2. After t23, the second set value INJ2_RSET increases with the increase rate defined by the second increase limiter ΔINJ2_RLMTUP2 until it catches up with the search value INJ2_RMAP (t23~t24). Since the second increase limiter ΔINJ2_RLMTUP2 is greater than the first increase limiter ΔINJ2_RLMTUP1, the increase rate of the second set value INJ2_RSET increases. Accordingly, a decrease rate of the first set value INJ1_RSET increases.

In accordance with the present embodiment, in the case where the running state changes rapidly to a state corresponding to the high engine speed range, the increase in the fuel injection ratio of the second injector 42 is suppressed, while the fuel injection ratio of the first injector 41 is increased in an initial period of the rapid change in the running state. This makes it possible to suitably suppress the fuel supplied to the combustion chamber 25 from becoming insufficient in amount, and improve acceleration performance.

Embodiment 3

Figure 13:
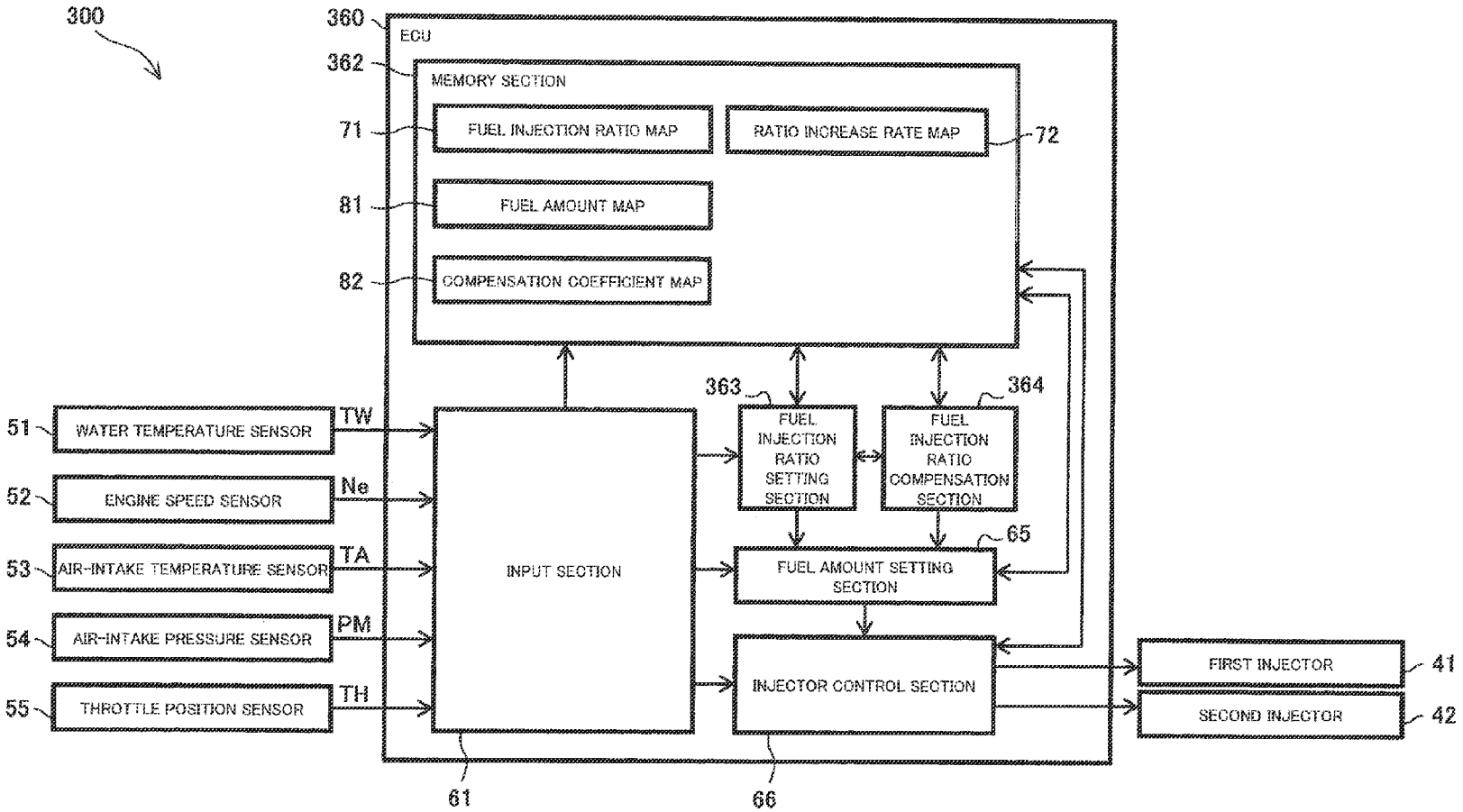
FIG. 13 is a block diagram showing a configuration of major components of a fuel injection control system according to Embodiment 3 of the present invention.
Figure 14:
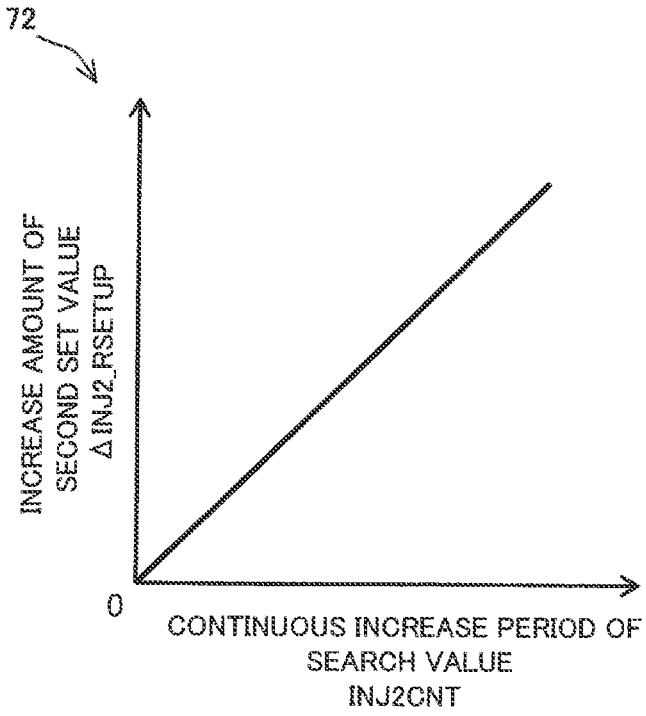
FIG. 14 is a graph schematically showing a ratio increase rate map stored in the memory section of FIG. 13.
Figure 15:
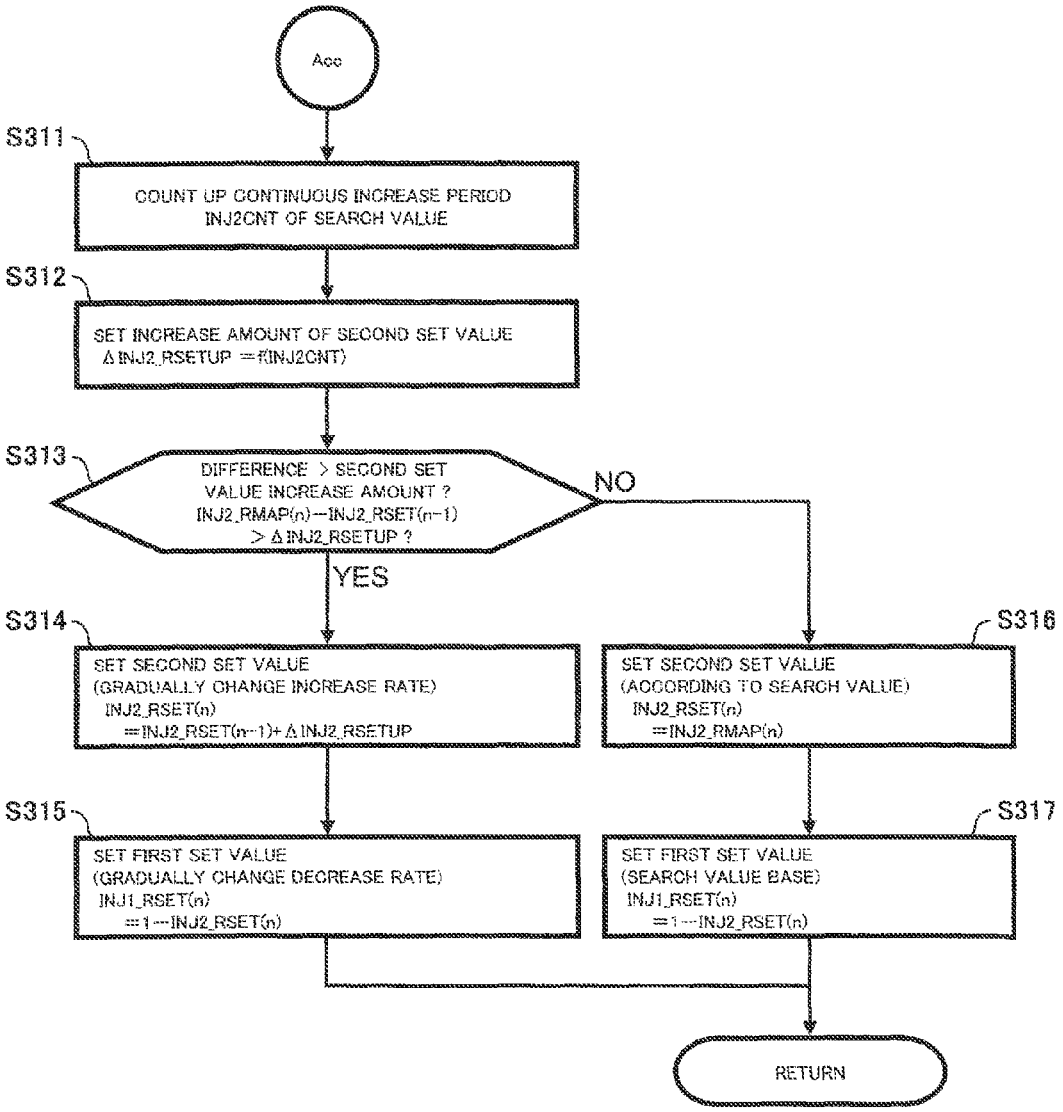
FIG. 15 is a flowchart showing a part of the fuel injection ratio setting process executed by the ECU of FIG. 13.

FIG. 13 is a block diagram showing a configuration of major components of a fuel injection control system 300 according to Embodiment 3 of the present invention. FIG. 14 is a graph schematically showing a ratio increase rate map 72 stored in a memory section 362 of FIG. 13. FIG. 15 is a flowchart showing a part of a fuel injection ratio setting process executed by an ECU 360 of FIG. 13. Hereinafter, the fuel injection control system 300 of Embodiment 3 of the present invention will be described, mainly regarding differences with the fuel injection control system 100 of Embodiment 1.

(ECU)

Referring to FIG. 13, in the present embodiment, the memory section 362 contains the fuel injection ratio map 71, the fuel amount map 81 and the compensation coefficient map 82 like the above embodiments. In addition, the memory section 362 contains a ratio increase rate map 72 instead of the increase limiters of the above embodiments. A fuel injection ratio setting section 363 and a fuel injection ratio compensation section 364 use the ratio increase rate map 72 in the process for setting the current value INJ1_RSET(n) of the first set value and the current value INJ2_RSET(n) of the second set value, in a case where the difference ΔINJ2_RERR is not less than zero. The ECC 360 executes the process shown in FIGS. 6 and 8 like in Embodiment 1, and executes the process shown in FIG. 15 instead of the process shown in FIG. 7.

Referring to FIG. 14, the ratio increase rate map 72 defines a correspondence between a period INJ2CNT (hereinafter referred to as a "continuous increase period") which passes from a time point when the search value starts increasing most recently, and an increase amount ΔINJ2_RSETUP of the second set value. The "time point when the search value starts increasing" is defined as a time point when the difference ΔINJ2_RERR obtained by subtracting the previous value INJ2_RSET(n−1) of the second set value from the current value INJ2_RMAP (n) of the search value becomes a value which is not less than zero. As the continuous increase period INJ2CNT of the search value is longer, the increase amount ΔINJ2_RSETUP of the second set value is greater.

(Setting of Fuel Injection Ratio During Acceleration, Etc.)

Referring to FIG. 15, if it is determined that the difference ΔINJ2_RERR is not less than zero, the fuel injection ratio setting section 363 counts up the continuous increase period INJ2CNT (step S311). The fuel injection ratio setting section 363 sets the increase amount ΔINJ2_RSETUP of the second set value according to the continuous increase period ΔINJ2CNT, with reference to the ratio increase rate map 72 (S312). Then, the fuel injection ratio setting section 363 determines whether or not the difference ΔINJ2_RERR is greater than the increase amount ΔINJ2_RSETUP of the second set value (step S313). If it is determined that the difference ΔINJ2_RERR is greater than the increase amount ΔINJ2_RSETUP (S313: YES), the fuel injection ratio compensation section 364 sets the current value INJ2_RSET(n) of the second set value using a formula (9) (step S314), and sets the current value INJ1_RSET(n) of the first set value using a formula (10) (step 315).

$$INJ2_RSET(n)=INJ2_RSET(n-1)+\Delta INJ2_RSETUP \quad (9)$$

$$INJ1_RSET(n)=1-INJ2_RSET(n) \quad (10)$$

If it is determined that the difference ΔINJ2_RERR is not greater than the increase amount ΔINJ2_RSETUP (S313: NO), the fuel injection ratio setting section 363 sets the current value INJ2_RSET(n) of the second set value using the formula (7) (step S316), and sets the current value INJ1_RSET(n) of the first set value using the formula (8) (step 317).

(Change in Fuel Injection Ratio which Occurs with Time)

Figure 16:
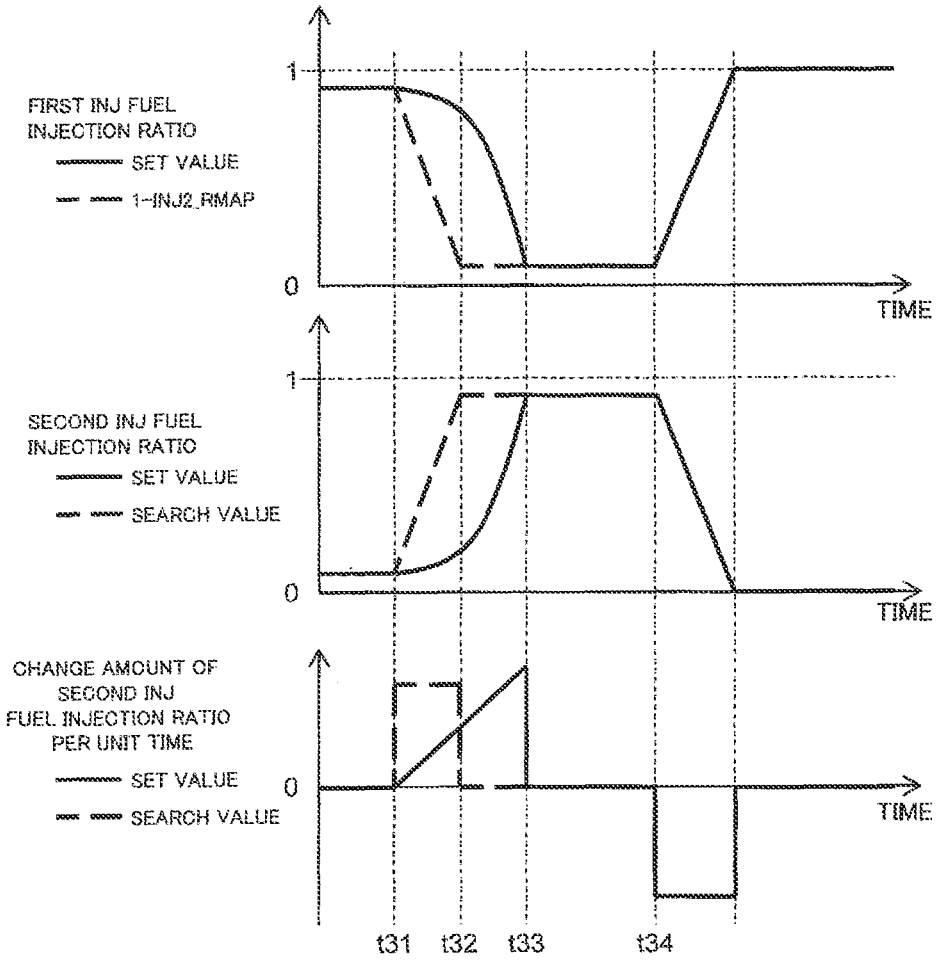
FIG. 16 is a time chart showing an exemplary time change in the fuel injection ratio of the first injector and an exemplary time change in the fuel injection ratio of the second injector in a case where the fuel injection ratio setting process shown in FIGS. 6, 8 and 15 is performed.

FIG. 16 is a time chart showing an exemplary time change in the fuel injection ratio of the first injector 41, an exemplary time change in the fuel injection ratio of the second injector 42, etc., in a case where the fuel injection ratio setting process shown in FIGS. 6, 8, and 15 is performed. Referring to FIG. 16, the search value INJ2_RMAP increases rapidly according to a change in the running state (t31~t32). The change in the values after the start of deceleration (after t34) is the same as that after t16 of Embodiment 1 and the description thereof is omitted. In this case, at time t31, the search value INJ2_RMAP starts increasing, and the second set value increases in such a manner that its increase rate increases gradually from zero as the continuous increase period INJ2SET increases, from t31. In the present embodiment, the increase amount ΔINJ2_RSETUP of the second set value increases linearly with respect to the continuous increase period INJ2CNT. Therefore, the second set value INJ2_RSET increases exponentially so as to draw a quadratic curve which is curved in a downward direction to form a convex shape as the continuous increase period INJ2CNT is longer. Conversely, the first set value INJ1_RSET decreases exponentially so as to draw a quadratic curve which is curved in an upward direction to form a convex shape as the continuous increase period INJ2CNT is longer. After the search value INJ2_RMAP stops increasing, the second set value INJ2_RSET quickly increases with the increase amount ΔINJ2_RSETUP corresponding to the continuous increase period INJ2CNT until the second set value INJ2_RSET catches up with the search value INJ2_RMAP so as to make up for the difference with the search value INJ2_RMAP (t32~t33).

In accordance with the present embodiment, in the case where the running state changes rapidly from a state corresponding to a low engine speed range to a state corresponding to a high engine speed range, the increase in the fuel injection ratio of the second injector 42 is suppressed, and as a result of this, the fuel injection ratio of the first injector 41 is greater, in an initial period of the rapid change in the running state. This makes it possible to suitably suppress the fuel supplied to the combustion chamber 25 from becoming insufficient in amount, and improve acceleration performance. Alternatively, the increase amount ΔINJ2_RSETUP of the second set value may increase nonlinearly with respect to the increase in the continuous increase period INJ2CNT. Although the increase amount ΔINJ2_RSETUP of the second set value is set to zero and increases gradually from zero, when the continuous increase period INJ2CNT is zero, this is merely exemplary. For example, the increase amount ΔINJ2_RSETUP of the second set value may be set to a positive value when the continuous increase period INJ2CNT is zero.

Embodiment 4

Figure 17:
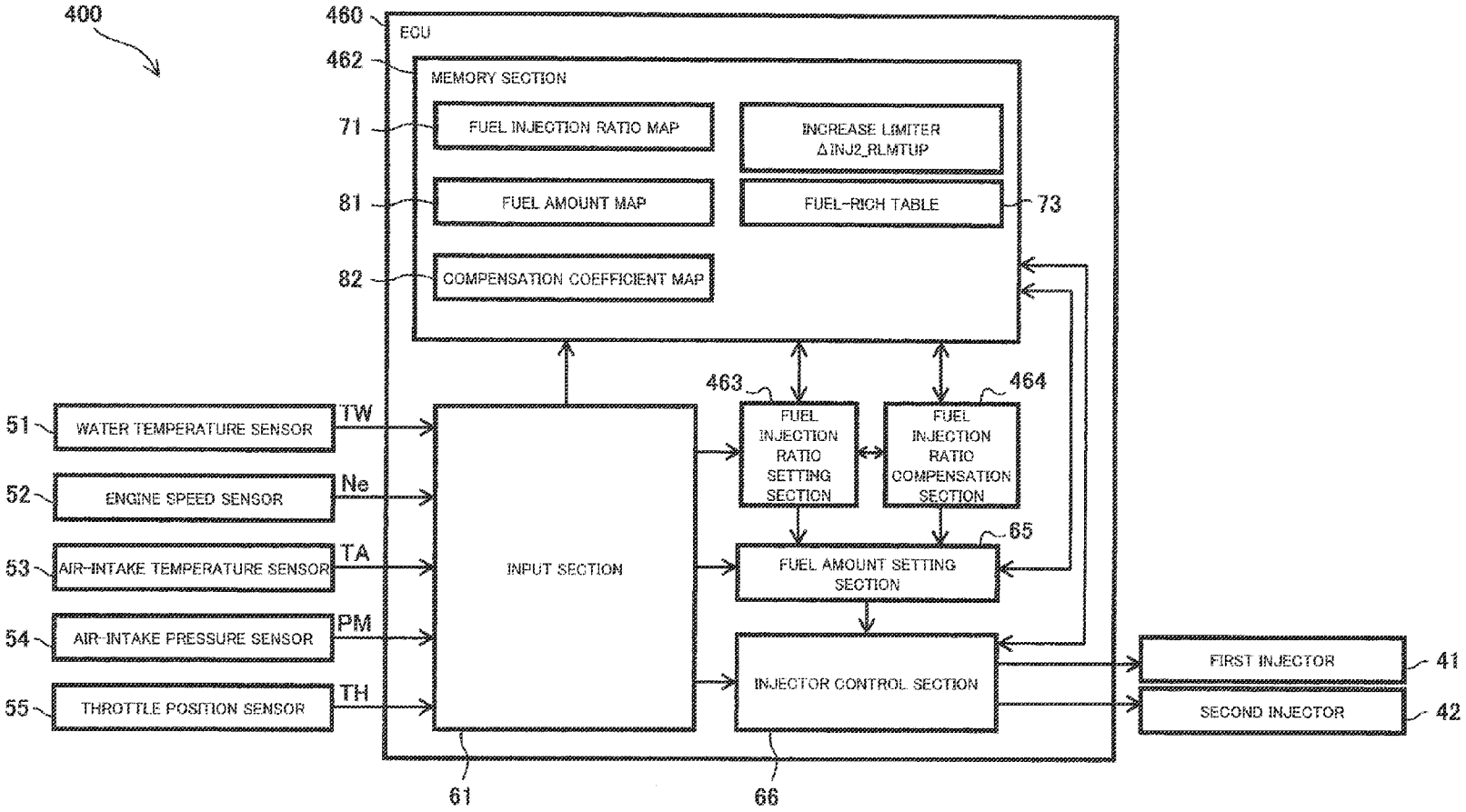
FIG. 17 is a block diagram showing a configuration of major components of a fuel injection control system according to Embodiment 4 of the present invention.
Figure 19:
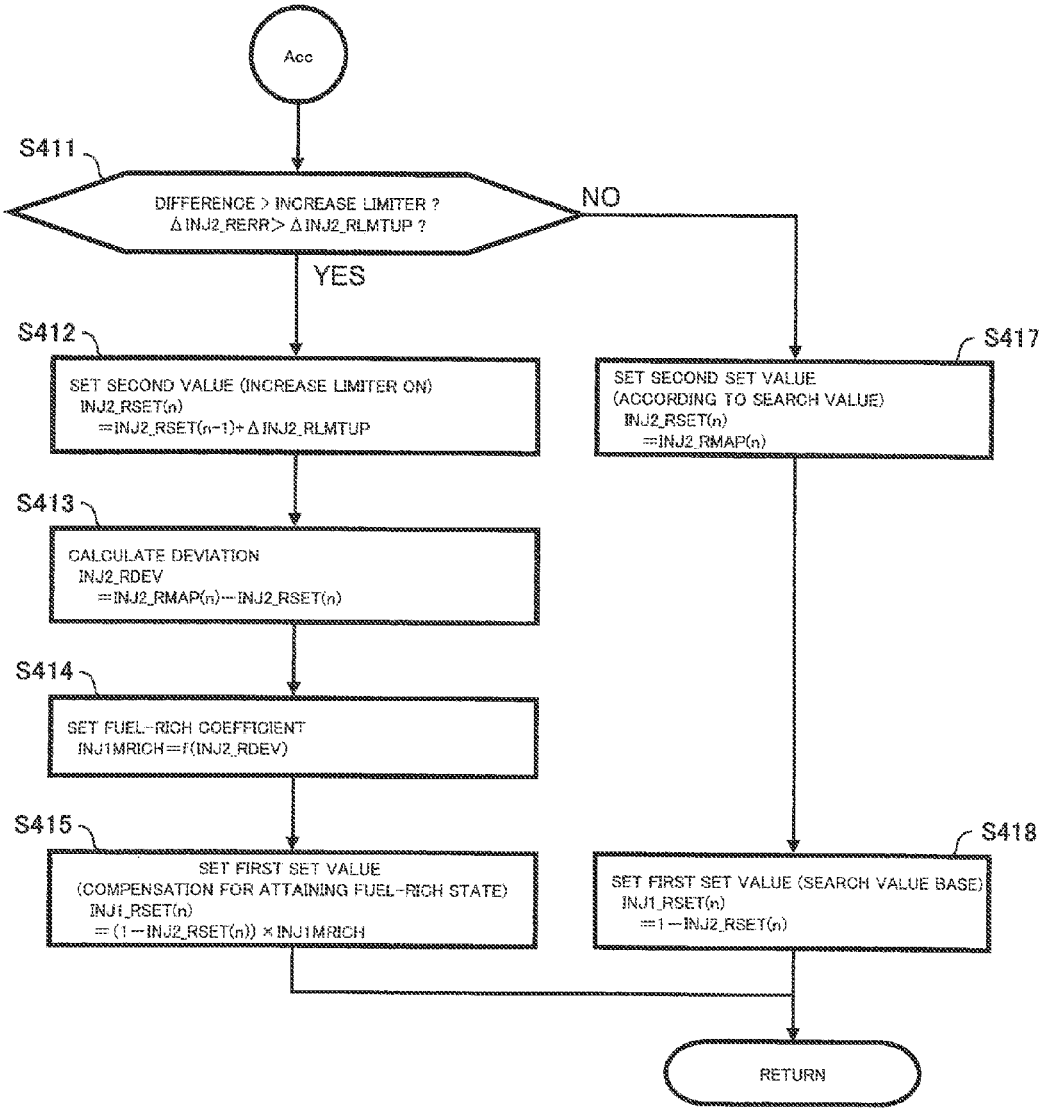
FIG. 19 is a flowchart showing a part of the fuel injection ratio setting process executed by the ECU of FIG. 17.

FIG. 17 is a block diagram showing a configuration of major components of a fuel injection control system 460 according to Embodiment 4 of the present invention. FIG. 18 is a schematic view of a fuel-rich coefficient table 73 stored in a memory section 463 of FIG. 17. FIG. 19 is a flowchart showing a part of the fuel injection ratio setting process executed by the ECU 460 of FIG. 17. Hereinafter, the fuel injection control system 400 of Embodiment 4 will be described, mainly regarding differences with the fuel injection control systems of the above embodiments.

(ECU)

Referring to FIG. 17, in the present embodiment, the memory section 462 contains the fuel injection ratio map 71, the fuel amount map 81, the compensation coefficient map 82, and the increase limiter ΔINJ2_RLMTUP, as in Embodiment 1. In addition, the memory section 462 contains a fuel-rich coefficient table 73. A fuel injection ratio setting section 463 and a fuel injection ratio compensation section 464 use the increase limiter ΔINJ2_RLMTUP and the fuel-rich coefficient table 73 in the process for setting the current value INJ1_RSET(n) of the first set value and the current value INJ2_RSET(n) of the second set value, in a case where the change amount ΔINJ2_RMAP is not less than zero. The ECC 460 executes the process shown in FIGS. 6 and 8, as in Embodiment 1, and executes the process shown in FIG. 19 instead of the process shown in FIG. 7.

As shown in FIG. 18, the fuel-rich coefficient table 73 defines a correspondence between a deviation INJ2_RDEV and a fuel-rich coefficient INJ1MRICH. The deviation INJ2_RDEV is obtained by subtracting the current value INJ2_RSET(n) of the second set value from the current value INJ2_RMAP(n) of the search value. As the deviation INJ2_RDEV increases, the fuel-rich coefficient INJ1MRICH increases. The numeric values shown in FIG. 18 are merely an example showing such a trend, and may be suitably modified.

(Setting of Fuel Injection Ratio During Acceleration, Etc.)

Referring to FIG. 19, if it is determined that the difference ΔINJ2_RERR is not less than zero, the fuel injection ratio setting section 463 determines whether or not the difference ΔINJ2_RERR is greater than the increase limiter ΔINJ2_RLMTUP (step S411). If it is determined that the difference ΔINJ2_RERR is greater than the increase limiter ΔINJ2_RLMTUP (S411: YES), the fuel injection ratio compensation section 464 sets the current value INJ2_RSET(n) of the second set value using the formula (5) (step S412).

Then, the fuel injection ratio compensation section 464 subtracts the current value INJ2_RSET(n) of the second set value from the current value INJ2_RMAP(n) of the search value, to derive a deviation INJ2_RDEV between these two values (step S413). The fuel injection ratio compensation section 464 sets the fuel-rich coefficient INJ1MRICH corresponding to the deviation INJ2_RDEV with reference to the fuel-rich coefficient table 73, by, for example, interpolation (step S414). The fuel injection ratio setting section 463 sets the current value INJ1_RSET(n) of the first set value using a formula (6d) (step S415).

$$INJ1_RSET(n)=(1-INJ2_RSET(n))\times INJ1MRICH$$

$$(\geq 1-INJ2_RSET(n)>1-INJ2_RMAP(n)) \quad (6d)$$

In Embodiment 1, the current value INJ1_RSET(n) of the first set value is set to a value obtained by subtracting the current value INJ2_RSET(n) of the second set value from 1, irrespective of whether or not the increase limiter ΔINJ2_RLMTUP is active. By comparison, in the present embodiment, the fuel-rich coefficient INJ1MRICH is used to make compensation for the value obtained by this subtraction. The compensation using the fuel-rich coefficient INJ1MRICH is carried out without changing the value of the second set value INJ2_RSET. Because of this, a sum of the current value INJ1_RSET(n) of the first set value and the current value INJ2_RSET(n) of the second set value becomes a value which is not less than 1. When the compensation using the fuel-rich coefficient INJ1MRICH is carried out, a total fuel injection amount TTOTALOUT becomes a value greater than a product (TIMAP×MTOTAL) of the base fuel amount TIMAP and the compensation coefficient MTOTAL (see formula (3)), and is increased by compensation using the set values of the fuel injection ratio.

If it is determined that the difference ΔINJ2_RERR is not greater than the increase limiter ΔINJ2_RLMTUP (S411: NO), the fuel injection ratio setting section 463 sets the current value INJ2_RSET(n) of the second set value using the formula (7) (step S417), and sets the current value INJ1_RSET(n) of the first set value using the formula (8) (step 418).

(Change in Fuel Injection Ratio which Occurs with Time)

Figure 20:
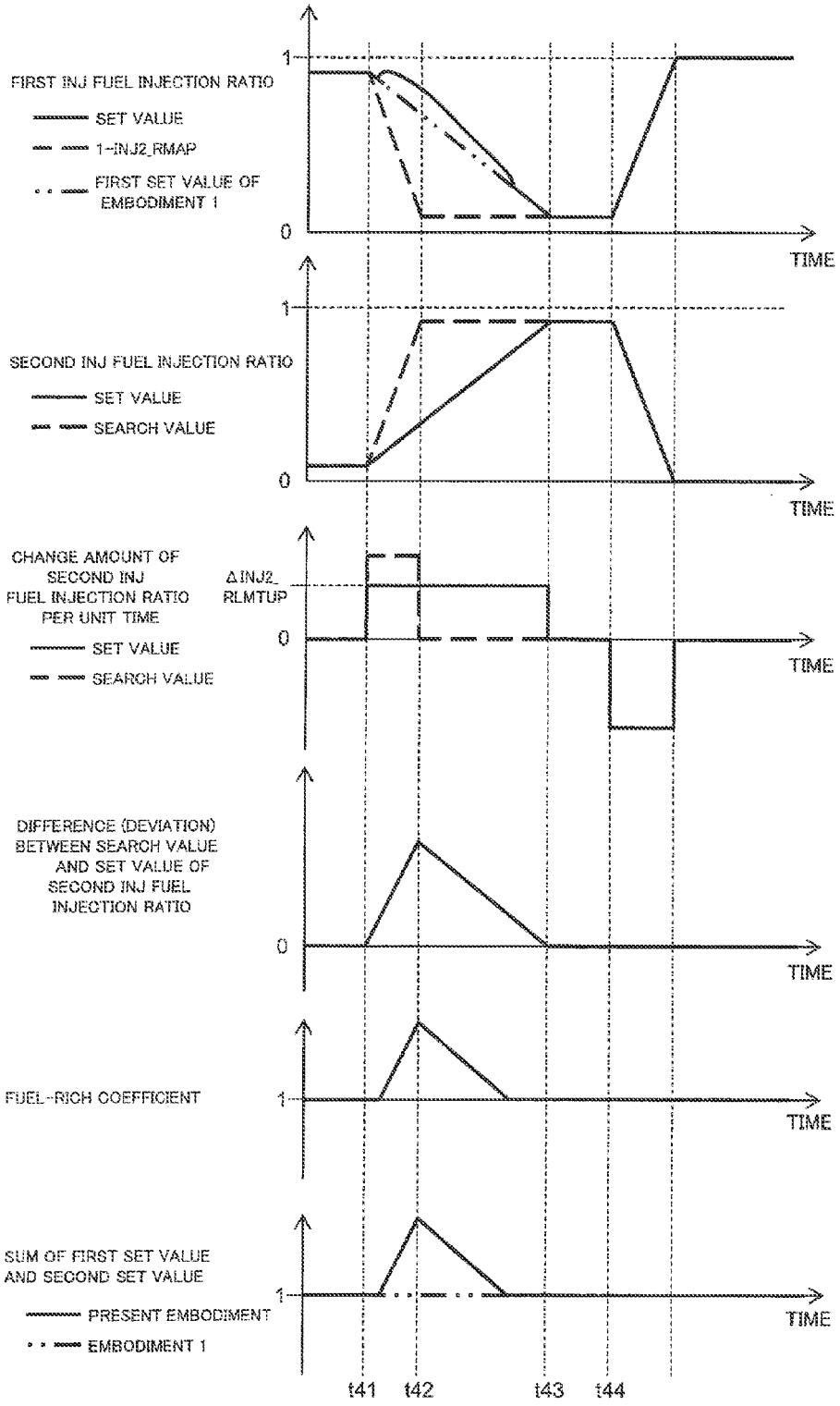
FIG. 20 is a time chart showing an exemplary time change in the fuel injection ratio of the first injector and an exemplary time change in the fuel injection ratio of the second injector in a case where the fuel injection ratio setting process shown in FIGS. 6, 8 and 19 is performed.

FIG. 20 is a time chart showing an exemplary time change in the fuel injection ratio of the first injector 41 and an exemplary time change in the fuel injection ratio of the second injector 42 in a case where the fuel injection ratio setting process shown in FIGS. 6, 8, and 19 is performed. Referring to FIG. 20, the search value INJ2_RMAP increases rapidly according to a change in the running state (t41~t42). It is assumed that the increase rate of the search value INJ2_RMAP is greater than the increase rate defined by the increase limiter ΔINJ2_RLMTUP. The change in the values just after start of deceleration (after t44) is the same as that after t16 in Embodiment 1, and description thereof is omitted.

When the search value INJ2_RMAP starts increasing, the second set value INJ2_RSET increases gradually with the increase rate defined by the increase limiter ΔINJ2_RLMTUP (t41~t43). During a period when the search value INJ2_RMAP continues to increase, the deviation INJ2_RDEV between the search value INJ2_RMAP and the second set value INJ2_RSET increases with a passage of time (time 41~t42).

Due to the increase in the deviation INJ2_RDEV, the fuel-rich coefficient INJ1MRICH increases with a passage of time. Since the fuel-rich coefficient INJ1MRICH increases, the first set value INJ1_RSET is set to a value derived by increasing by compensation the value (i.e., first set value in Embodiment 1) obtained by subtracting the second set value INJ2_RSET from 1 (time t41~t42).

After time t42 when the search value INJ2_RMAP stops increasing, the second set value INJ2_RSET continues to increase gradually with an increase rate defined by the increase limiter ΔINJ2_RLMTUP so as to gradually make up for a difference with the search value INJ2_RMAP (time t42~t43). Therefore, the deviation INJ2_RDEV diminishes gradually, and the fuel-rich coefficient INJ1MRICH decreases gradually towards 1. As a result, the first set value INJ1_RSET is approaching the value (first set value in Embodiment 1) obtained by subtracting the second set value INJ2_RSET from 1.

In accordance with the present embodiment, in the case where the running state changes rapidly to a state corresponding to the high engine speed range, the increase in the fuel injection ratio of the second injector 42 is suppressed so that the fuel injection ratio of the first injector 41 is increased passively. In addition, the fuel injection ratio of the first injector 41 is increased actively by compensation to thereby increase the total fuel injection amount by compensation. This makes it possible to suitably suppress the fuel supplied to the combustion chamber 25 from becoming insufficient in amount, and improve acceleration performance. Although in the present embodiment, the fuel-rich coefficient INJ1MRICH is derived based on the deviation, it may be derived based on the above stated difference ΔINJ2_RERR.

Embodiment 5

Figure 21:
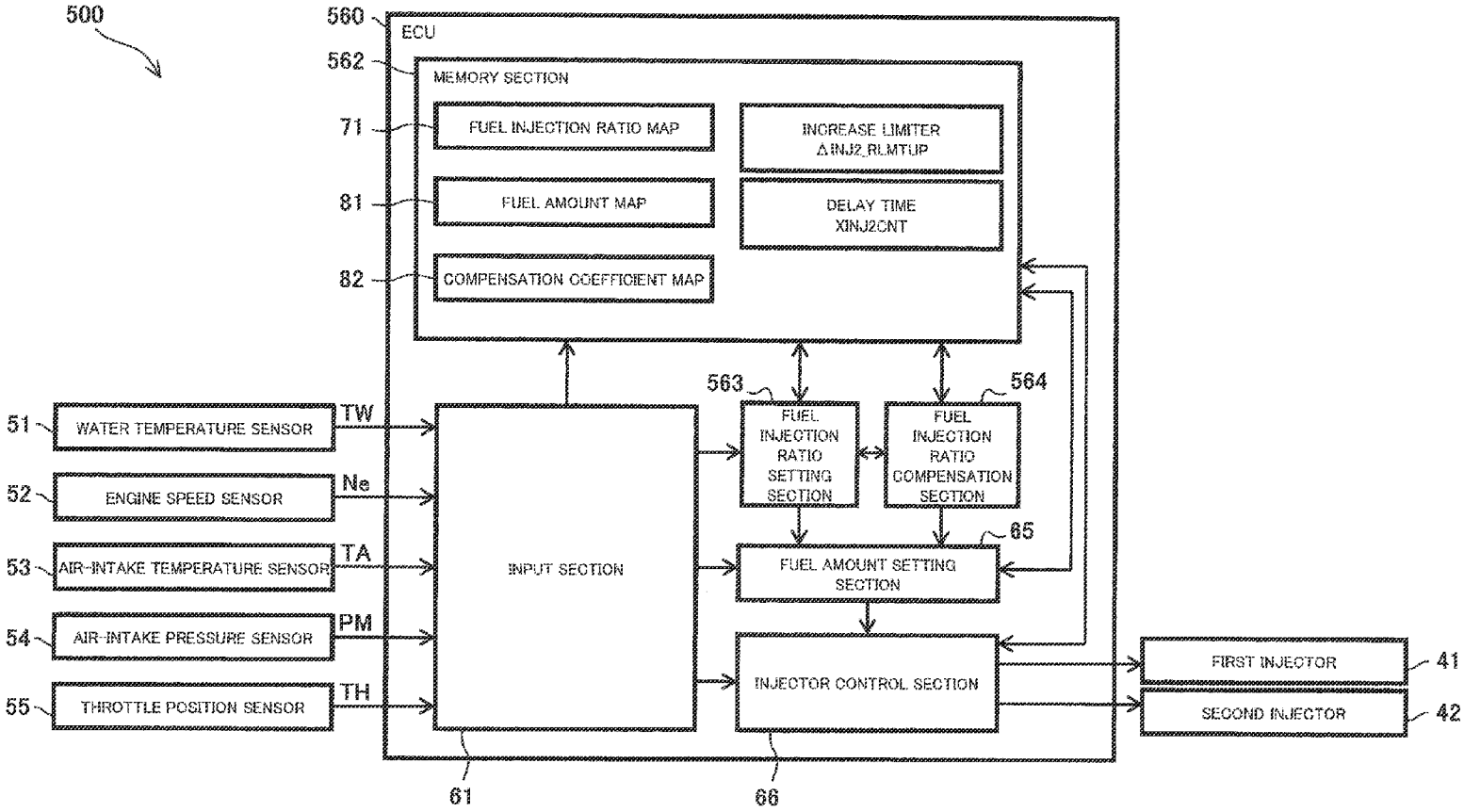
FIG. 21 is a block diagram showing a configuration of major components of a fuel injection control system according to Embodiment 5 of the present invention.
Figure 22:
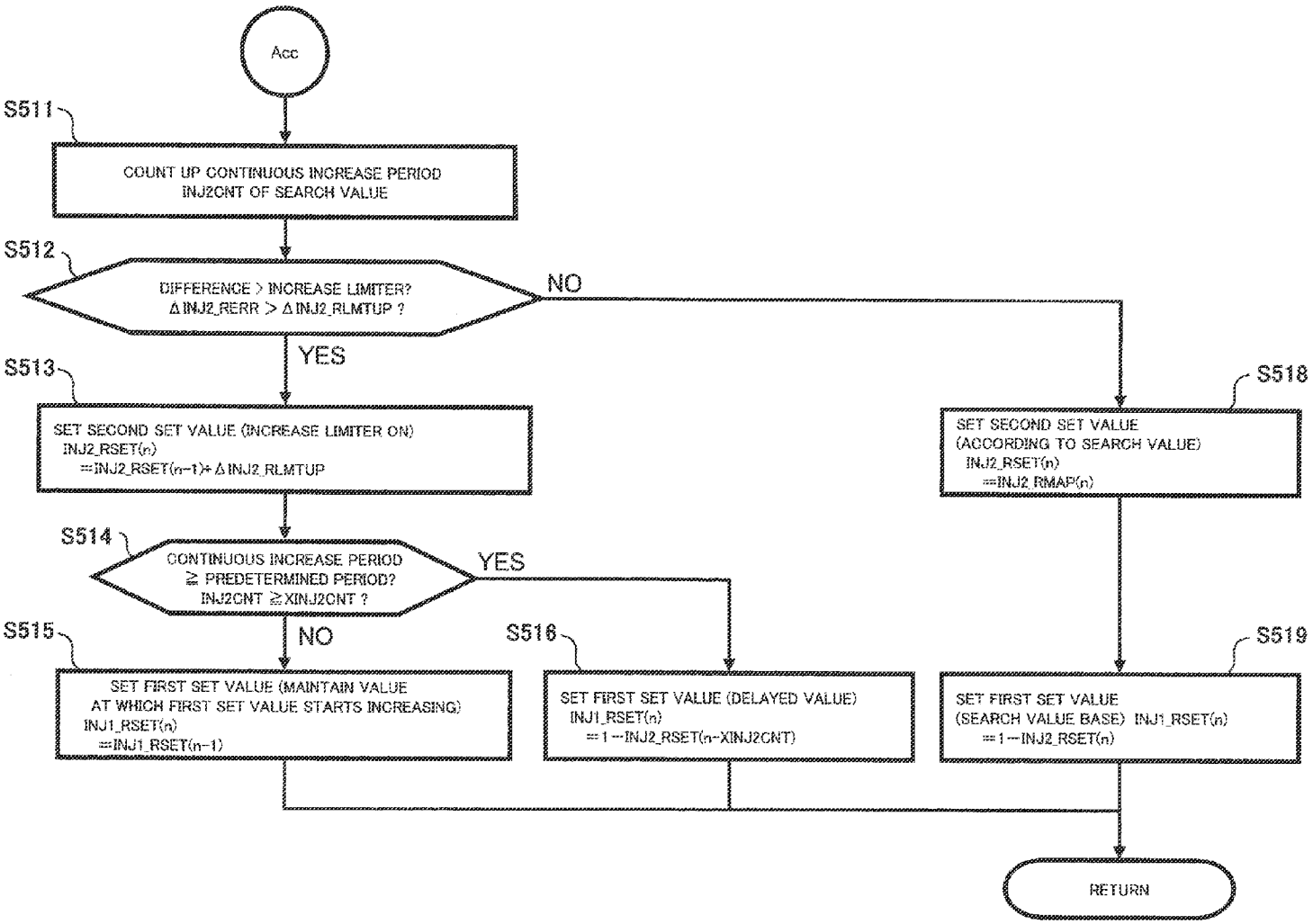
FIG. 22 is a flowchart showing a part of the fuel injection ratio setting process executed by the ECU of FIG. 21.

FIG. 21 is a block diagram showing a configuration of major components of a fuel injection control system 500 according to Embodiment 5 of the present invention. FIG. 22 is a flowchart showing a part of the fuel injection ratio setting process executed by an ECU 560 of FIG. 21. Hereinafter, the fuel injection control system 500 of Embodiment 5 of the present invention will be described, mainly regarding differences with the fuel injection control systems of the above embodiments.

(ECU)

Referring to FIG. 21, in the present embodiment, a memory section 562 contains the fuel injection ratio map 71, the fuel amount map 81, the compensation coefficient map 82, and the increase limiter ΔINJ2_RLMTUP, as in Embodiment 1. In addition, the memory section 562 contains a delay period XINJ2CNT. The delay period XINJ2CNT is a value substantially equal to a time period from when a command for opening the second injector 42 is issued to the second injector 42 until when the fuel injected from the second injector 42 reaches the combustion chamber 25. This value can be derived from a driving test or numeric value analysis using an actual motorcycle. A fuel injection ratio setting section 563 and a fuel injection ratio compensation section 564 use the increase limiter ΔINJ2_RLMTUP and the delay period XINJ2CNT in the process for setting the current value INJ1_RSET(n) of the first set value and the current value INJ2_RSET(n) of the second set value, in a case where the difference ΔINJ2_RERR is not less than zero. The ECC 560 executes the process shown in FIGS. 6 and 8, as in Embodiment 1, and executes the process shown in FIG. 22 instead of the process shown in FIG. 7.

(Setting of Fuel Injection Ratio During Acceleration, Etc.)

Referring to FIG. 22, if it is determined that the difference ΔINJ2_RERR is not less than zero, the fuel injection ratio setting section 563 counts up the continuous increase period INJ2CNT (step S511). Then, the fuel injection ratio setting section 563 determines whether or not the difference ΔINJ2_RERR is greater than the increase limiter ΔINJ2_RLMTUP (step S512). If it is determined that the difference ΔINJ2_RERR is greater than the increase limiter ΔINJ2_RLMTUP (S512: YES), the fuel injection ratio compensation section 564 sets the current value INJ2_RSET(n) of the second set value using the formula (5) (step S513).

Then, the fuel injection ratio compensation section 564 determines whether or not the continuous increase period INJ2CNT has reached a predetermined period (delay period) XINJ2CNT pre-stored in the memory section 562 (step S514). If it is determined that the continuous increase period INJ2CNT has not reached the delay period XINJ2CNT (S514: NO), the fuel injection ratio compensation section 564 sets the current value INJ1_RSET(n) of the first set value using a formula (6e) (step S515). If it is determined that the continuous increase period INJ2CNT has reached the delay period XINJ2CNT (S514: YES), the fuel injection ratio compensation section 563 sets the current value INJ1_RSET(n) of the first set value using a formula (6f) (step S516).

$$INJ1_RSET(n)=INJ1_RSET(n-1) \tag{6e}$$

$$INJ1_RSET(n)=1-INJ2_RSET(n-XINJ2CNT)$$

$$(>1-INJ2_RSET(n)>1-INJ2_RMAP(n)) \tag{6f}$$

In this way, during a period when the continuous increase period INJ2CNT has not reached the delay period XINJ2CNT, the current value INJ1_RSET(n) of the first set value is maintained at a value at a time point when the search value INJ2_RMAP starts increasing, even when the second set value INJ2_RSET increases along with the search value INJ2_RMAP. When the continuous increase period INJ2CNT has reached the delay period XINJ2CNT, the first set value INJ1_RSET is set to a value obtained by subtracting a second set value INJ2_RSET(n−XINJ2CNT) which was set in the past which was the delay period XINJ2CNT back from the current time. That is, the current value INJ1_RSET(n) of the first set value starts decreasing after a passage of the delay period XINJ2CNT from a time point when the current value INJ2_RSET(n) of the second set value starts increasing. Thus, of course, the first set value INJ1_RSET is set to a value greater than a value (1−INJ2_RMAP(n)) of the fuel injection ratio of the first injector 41 which is derived from the fuel injection ratio map 71. And, the first set value INJ1_RSET is set to a value greater than the value (i.e., first set value in Embodiment 1) obtained by subtracting the current value INJ2_RSET(n) of the second set value which is set based on the increase limiter being active, from 1. In the present embodiment, as in Embodiment 4, a sum of the current value INJ1_RSET(n) of the first set value, and the current value INJ2_RSET(n) of the second set value exceeds 1, and the total fuel injection amount TTOTALOUT is increased by compensation.

If it is determined that the difference ΔINJ2_RERR is not greater than the increase limiter ΔINJ2_RLMTUP (step S512: NO), the fuel injection ratio setting section 563 sets the current value INJ2_RSET(n) of the second set value using the formula (7) (step S518), and sets the current value INJ1_RSET(n) of the first set value using the formula (8) (step 519).

(Change in Fuel Injection Ratio which Occurs with Time)

Figure 23:
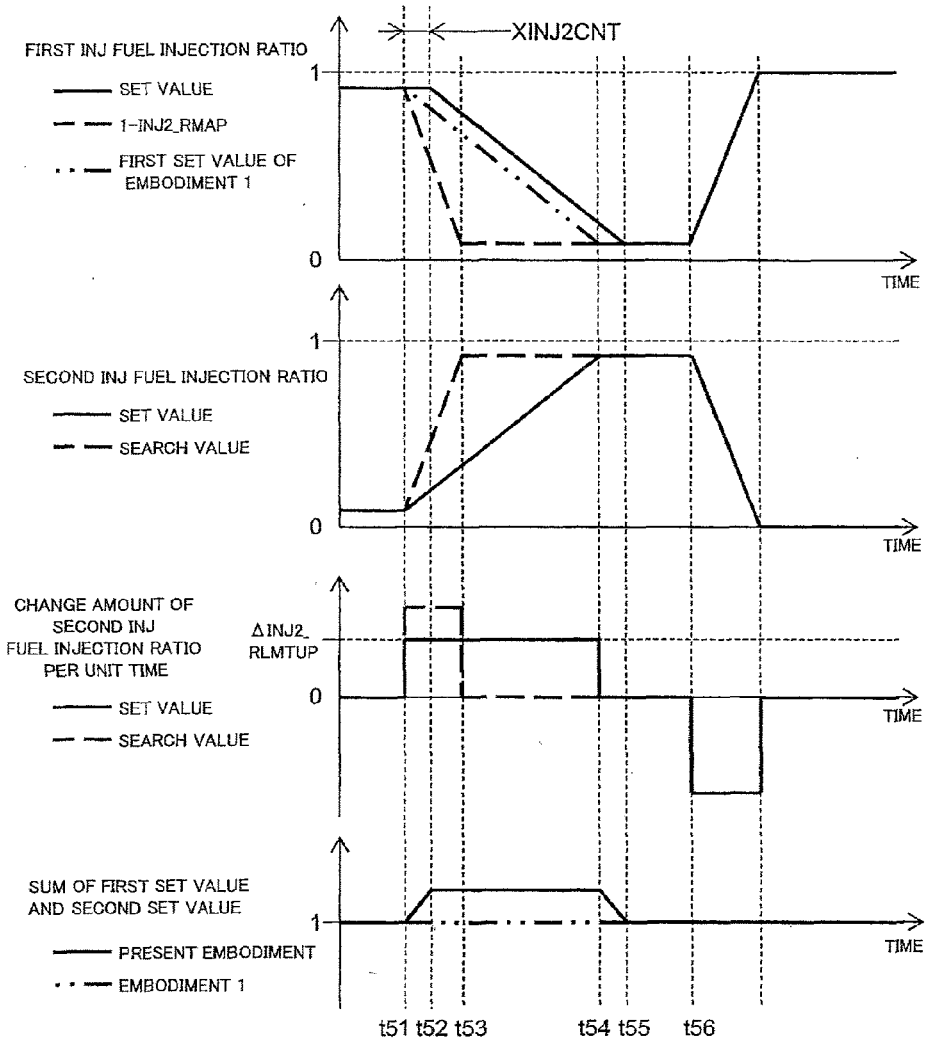
FIG. 23 is a time chart showing an exemplary time change in the fuel injection ratio of the first injector and an exemplary time change in the fuel injection ratio of the second injector in a case where the fuel injection ratio setting process shown in FIGS. 6, 8 and 22 is performed.

FIG. 23 is a time chart showing an exemplary time change in the fuel injection ratio of the first injector 41 and an exemplary time change in the fuel injection ratio of the second injector 42 in a case where the fuel injection ratio setting process shown in FIGS. 6, 8, and 22 is performed. Referring to FIG. 23, the search value INJ2_RMAP increases rapidly according to a change in the running state (t51~t53). The increase rate of the search value INJ2_RMAP is set greater than the increase rate defined by the increase limiter ΔINJ2_RLMTUP. The change in the values after the start of deceleration (after t56) is the same as that after t16 of Embodiment 1 and description thereof is omitted.

When the search value INJ2_RMAP starts increasing, the second set value INJ2_RSET increases gradually with the increase rate defined by the increase limiter ΔINJ2_RLMTUP (t51~t54). During a time period from a time t51 when the search value INJ2_RMAP starts increasing until the delay period XINJ2CNT has passed, the first set value INJ1_RSET is set to the value set at t51 (t51~t52). Therefore, a sum of the first set value INJ1_RSET and the second set value INJ2_RSET increases gradually from 1 (t51~t52). After the continuous increase period INJ2CNT has passed the delay period XINJ2CNT, the first set value INJ2_RSET is set to a value corresponding to a time delayed by the delay period XINJ2CNT and decreases with a passage of time (t52~t55). A sum of the first set value INJ1_RSET and the second set value INJ2_RSET decreases gradually toward 1 from t54 when the second set value INJ2_RSET has caught up with the search value INJ2_RMAP (t54~t55).

As should be appreciated from the above, in the present embodiment, in the case where the running state changes rapidly to a state corresponding to a high engine speed range, the value of the fuel injection ratio of the first injector 41 is not changed in an initial period of the rapid change in the running range, and thereby the fuel injection amount of the first injector 41 is increased. This makes it possible to suitably suppress the fuel supplied to the combustion chamber 25 from becoming insufficient in amount, and improve acceleration performance.

Embodiment 6

Figure 24:
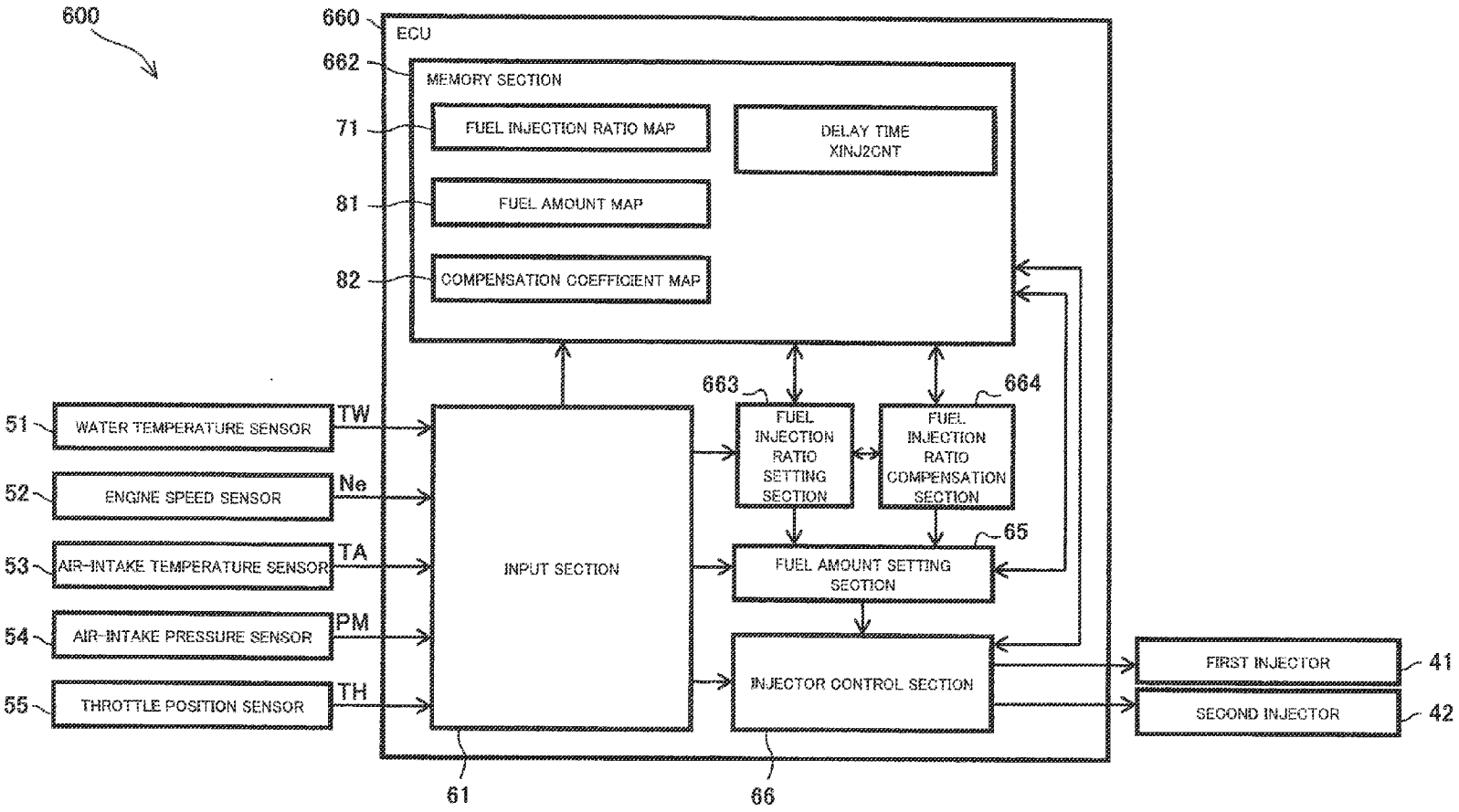
FIG. 24 is a block diagram showing a configuration of major components of a fuel injection control system according to Embodiment 6 of the present invention.
Figure 25:
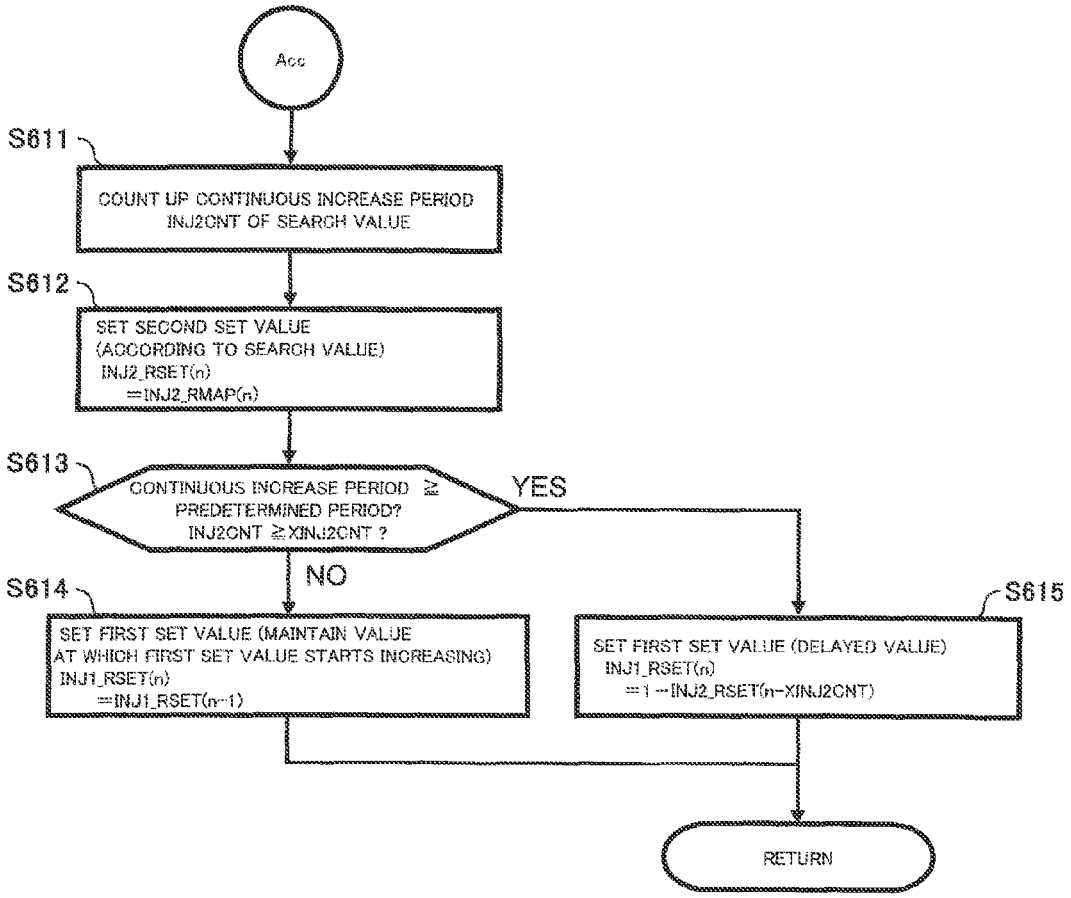
FIG. 25 is a flowchart showing a part of the fuel injection ratio setting process executed by the ECU of FIG. 24.

FIG. 24 is a block diagram showing a configuration of major components of a fuel injection control system 600 according to Embodiment 6 of the present invention. FIG. 25 is a flowchart showing a part of a fuel injection ratio setting process executed by an ECU 660 of FIG. 24. Hereinafter, the fuel injection control system 600 of Embodiment 6 of the present invention will be described, mainly regarding differences with the fuel injection control systems of the above embodiments.

(ECU)

Referring to FIG. 24, in the present embodiment, the memory section 662 contains the fuel injection ratio map 71 and the delay period XINJ2CNT, as in Embodiment 5, but does not contain the increase limiter. A fuel injection ratio setting section 663 and a fuel injection ratio compensation section 664 use the delay period XINJ2CNT in the process for setting the current value INJ1_RSET(n) of the first set value and the current value INJ2_RSET(n) of the second set value, in a case where the difference ΔINJ2_RERR is not less than zero. The ECC 660 executes the process shown in FIGS. 6 and 8, as in Embodiment 1, and executes the process shown in FIG. 25 instead of the process shown in FIG. 7.

(Setting of Fuel Injection Ratio During Acceleration, Etc.)

Referring to FIG. 25, if it is determined that the difference ΔINJ2_RERR is not less than zero, the fuel injection ratio setting section 663 counts up the continuous increase period INJ2CNT (step S611). Then, the fuel injection ratio setting section 663 sets the current value INJ2_RSET(n) of the second set value using the formula (7) (step S612). Then, the fuel injection ratio setting section 663 determines whether or not the continuous increase period INJ2CNT has reached a predetermined period (delay period) XINJ2CNT pre-stored in the memory section 662 (step S613). If it is determined that the continuous increase period INJ2CNT has not reached the delay period XINJ2CNT (step S613: NO), the fuel injection ratio compensation section 664 sets the current value INJ1_RSET(n) of the first set value using the formula (6e) (step S614). If it is determined that the continuous increase period INJ2CNT has reached the delay period XINJ2CNT (step S613: YES), the fuel injection ratio compensation section 664 sets the current value INJ1_RSET(n) of the first set value using the formula (6f) (step S615). That is, in the present embodiment, the current value INJ2_RSET(n) of the second set value is set to the current value INJ2_RMAP(n) of the search value irrespective of the increase rate of the search value, whereas the current value INJ1_RSET(n) of the first set value is set in the same manner as in Embodiment 5.

(Change in Fuel Injection Ratio which Occurs with Time)

Figure 26:
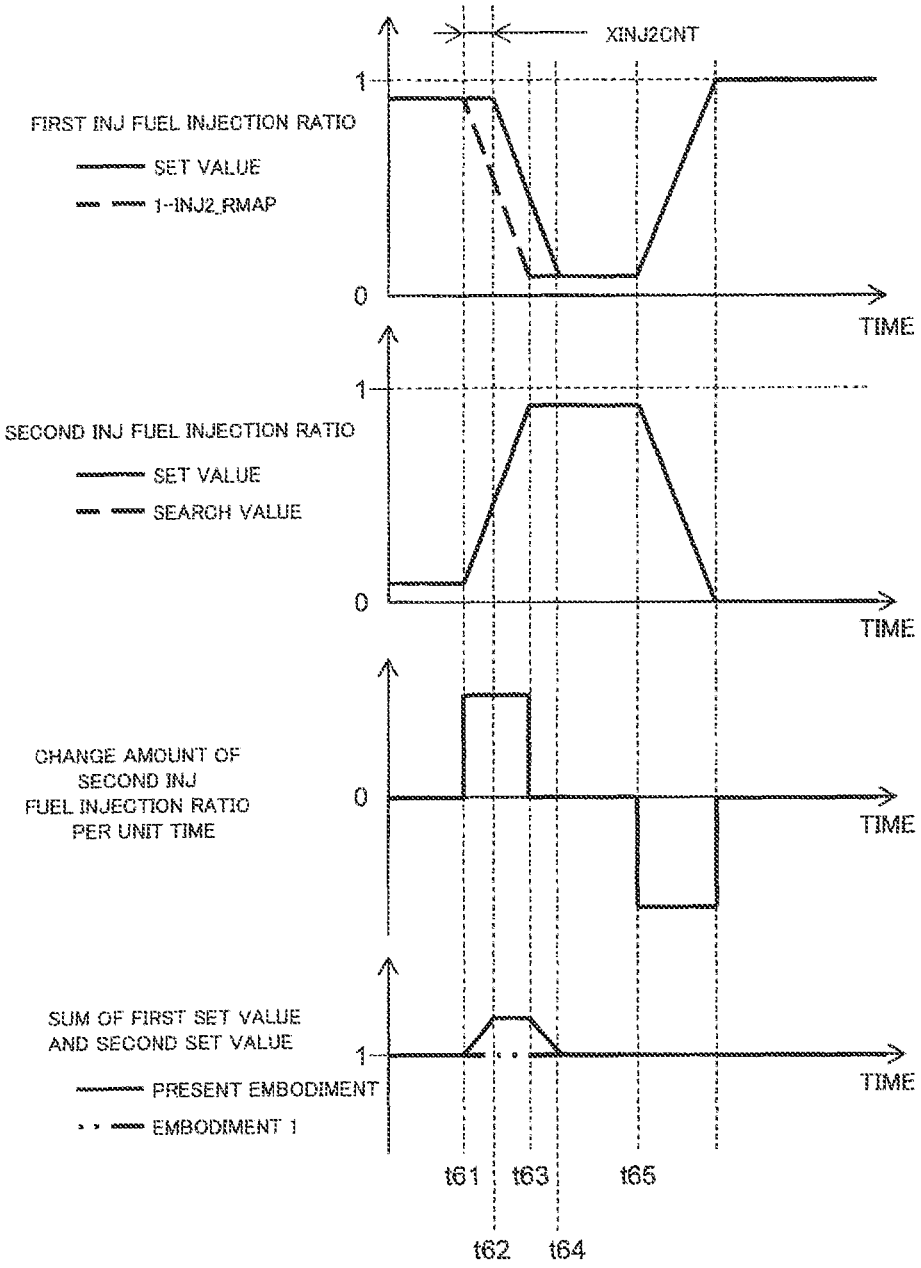
FIG. 26 is a time chart showing an exemplary time change in the fuel injection ratio of the first injector and an exemplary time change in the fuel injection ratio of the second injector in a case where the fuel injection ratio setting process shown in FIGS. 6, 8 and 25 is performed.

FIG. 26 is a time chart showing an exemplary time change in the fuel injection ratio of the first injector 41 and an exemplary time change in the fuel injection ratio of the second injector 42 in a case where the fuel injection ratio setting process shown in FIGS. 6, 8, and 25 is performed. Referring to FIG. 26, the search value INJ2_RMAP increases rapidly according to a change in the running states (t61~t63). The change in the values after start of deceleration (after t65) is the same as that of Embodiment 1 and description thereof is omitted.

When the search value INJ2_RMAP starts increasing, the second set value INJ2_RSET is set to the search value INJ2_RMAP (t61~t63). As in the case of Embodiment 5, the first set value INJ1_RSET is maintained at the value set at t61 from when the search value INJ2_RMAP starts increasing until the delay period XINJ2CNT has passed (t61~t62). Therefore, a sum of the first set value INJ1_RSET and the second set value INJ2_RSET increases gradually from 1 (t61~t62). After the continuous increase period INJ2CNT has passed the delay period XINJ2CNT, the first set value INJ1_RSET is set to a value which is obtained by subtracting from 1, a second set value INJ2_RSET which is back from a current second set value by the delay period XINJ2CNT and decreases with a passage of time (t62~t64). The sum of the first set value INJ1_RSET and the second set value INJ2_RSET increases gradually toward 1 from t63 when the second set value INJ2_RSET has caught up with the search value INJ2_RMAP (t63~t64).

As should be appreciated from the above, in the present embodiment, in the case where the running state changes rapidly to a state corresponding to a high engine speed range, the fuel injection ratio of the first injector 41 is not changed and thereby the fuel injection amount of the first injector 41 is increased, in an initial period of the rapid change in the running range, although the increase limiter for suppressing the increase in the second set value INJ2_RSET is not activated. This makes it possible to suitably suppress the fuel supplied to the combustion chamber 25 from becoming insufficient in amount, and improve acceleration performance.

Embodiment 7

Figure 27:
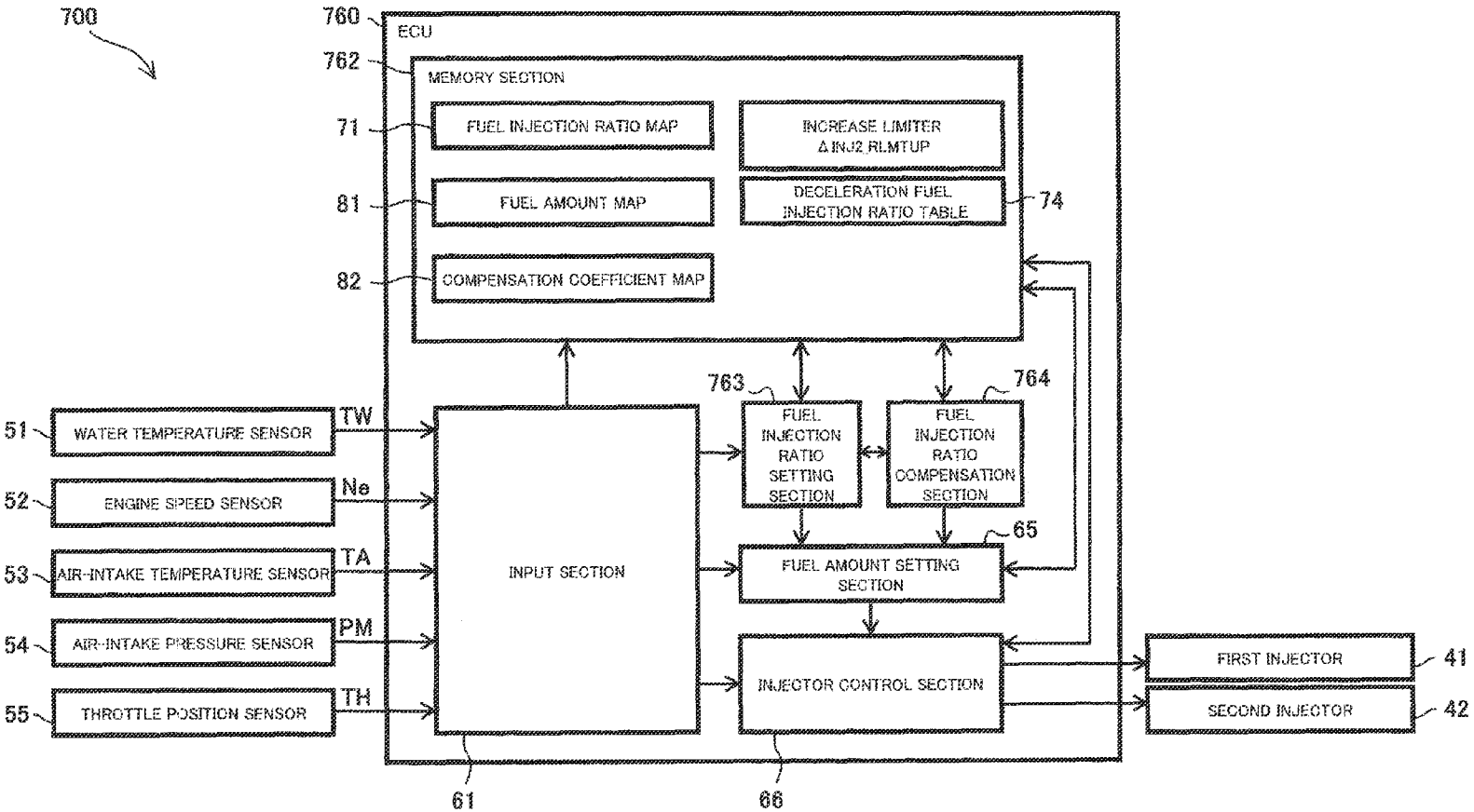
FIG. 27 is a block diagram showing a configuration of major components of the fuel injection control system according to Embodiment 7 of the present invention.
Figure 29:
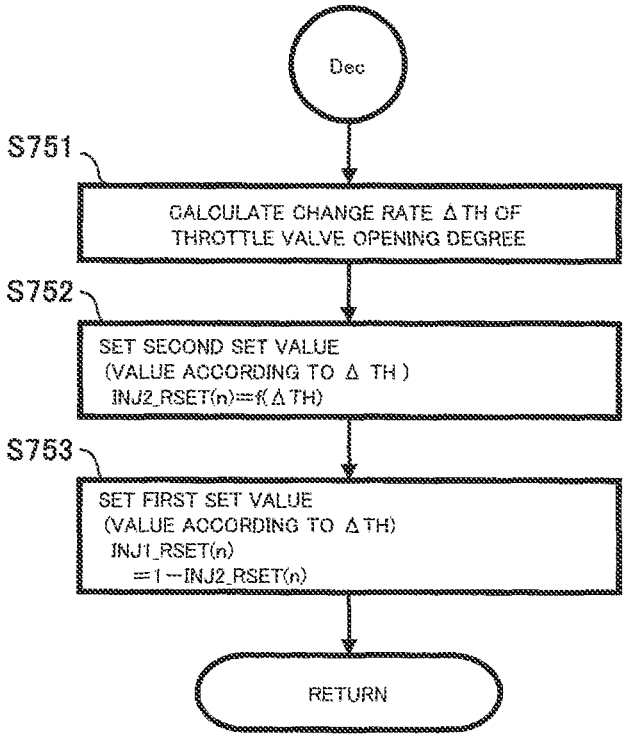
FIG. 29 is a flowchart showing a part of the fuel injection ratio setting process executed by the ECU of FIG. 27.

FIG. 27 is a block diagram showing a configuration of major components of a fuel injection control system 700 according to Embodiment 7 of the present invention. FIG. 28 is a schematic view showing a deceleration fuel injection ratio table 74 stored in a memory section 762 of FIG. 27. FIG. 29 is a flowchart showing a part of the fuel injection ratio setting process executed by an ECU 760 of FIG. 27. Hereinafter, the fuel injection control system 700 of Embodiment 7 of the present invention will be described, mainly regarding differences with the fuel injection control systems of the above embodiments.

(ECU)

Referring to FIG. 27, in the present embodiment, a memory section 762 contains the fuel injection ratio map 71, the fuel amount map 81, the compensation coefficient map 82, and the increase limiter ΔINJ2_RLMTUP, as in Embodiment 1. In addition, the memory section 762 contains a deceleration fuel injection ratio table 74. A fuel injection ratio setting section 763 uses the deceleration fuel injection ratio table 74 in the process for setting the first set value INJ1_RSET and the second set value INJ2_RSET, in a case where the difference ΔINJ2_RERR is less than zero. The ECC 760 executes the process shown in FIGS. 6 and 7 as in Embodiment 1, and executes the process shown in FIG. 29 instead of the process shown in FIG. 8.

Referring to FIG. 28, the deceleration fuel injection ratio table 74 defines a correspondence between a change rate (amount) ΔTH of the throttle valve opening degree and the second set value INJ2_RSET. As the change rate ΔTH of the throttle valve opening degree is set smaller, the second set value INJ2_RSET is set to a smaller value. The numeric values shown in FIG. 28 are merely an example showing such a trend, and may be suitably modified.

(Setting of Fuel Injection Ratio During Deceleration, Etc.)

Referring to FIG. 29, if it is determined that the difference ΔINJ2_RERR is less than zero, the fuel injection ratio setting section 763 calculates a change rate (amount) ΔTH of the throttle valve opening degree (step S751). The change rate ΔTH of the throttle valve opening degree can be calculated by subtracting a previous value of the throttle valve opening degree TH from a current value of the throttle valve opening degree TH. Then, the fuel injection ratio setting section 763 sets the current value INJ2_RSET(n) of the second set value according to the change rate ΔTH of the throttle valve opening degree, with reference to the deceleration fuel injection ratio table 74 (step S752). Then, the fuel injection ratio setting section 763 sets the current value INJ1_RSET(n) of the first set value using the formula (8) (step S753). In other words, the current value INJ1_RSET(n) of the first set value is set to the value obtained by subtracting the current value INJ2_RSET (n) of the second set value from 1. With this setting, the fuel injection ratio can be changed sensitively in response to a change in the throttle opening degree which is moved to a closed position.

Modified Examples

Thus far, the embodiments of the present invention have been described. The configurations and processes described above can be altered suitably. For example, the fuel injection ratio during acceleration, etc., may be set by the process of any one of Embodiment 2 to Embodiment 6, and the fuel injection ratio during deceleration, etc., may be set by the process of Embodiment 7. In a further alternative, switching of the increase limiter of Embodiment 2 may be applied to the setting process of the second set value of Embodiment 3 to Embodiment 5.

The switching of the increase limiter of Embodiment 2 is not limited to the switching performed based on comparison between the limiter switch threshold and the second set value. For example, the first increase limiter may be active until the continuous increase period has passed the predetermined period, and then the second increase limiter may be made active after a passage of the predetermined period. The fuel-rich coefficient of Embodiment 4 may be set according to the continuous increase period. The condition used for making compensation so that the first set value INJ1_RSET is greater than the fuel injection ratio of the first injector 41 which is derived from the fuel injection ratio map 71 is not limited to the above condition in which the difference between the current value INJ2_RMAP(n) of the search value and the past value (previous value) INJ2_RSET(n−1) of the second set value exceeds the predetermined threshold greater than zero, but may be a condition in which a difference between the current value INJ2_RMAP(n) of the search value and the previous value INJ2_RMAP (n−1) of the search value exceeds a predetermined threshold greater than zero. In this case, a programming technique may be used, in which, for example, a flag is set in the flow of FIG. 7 to ensure a situation in which, as shown in t13~t14 of FIG. 9, the second set value INJ2_RSET continues to increase gradually with the increase rate defined by the increase limiter ΔINJ2_RLMTUP even when the search value INJ2_RMAP changes from increasing to decreasing.

The fuel injection control systems of the embodiments of the present invention may be suitably incorporated into motorcycles of another types as well as the motorcycles of a motocross type, and may be incorporated into vehicles other than the motorcycles, for example, all terrain vehicles, personal watercraft, etc.

The present invention can achieve advantages that the fuel supplied actually to the combustion chamber from becoming insufficient in amount, when the fuel injection ratio of the second injector is increased in control of the twin injectors, and are widely applicable to engines including the twin injectors. In particular, the present invention is effectively incorporated into off-road vehicles having a tendency that an engine running state frequently changes rapidly, due to a quick (rapid) operation of a throttle grip, a spin of wheels, jump of a vehicle body, and other factors.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A fuel injection control system comprising:

a first injector for injecting a fuel to an air-intake passage to supply the fuel to an engine;

a second injector for injecting the fuel to the air-intake passage to supply the fuel to the engine, the second injector being positioned upstream of the first injector in an air flow direction;

a memory section which contains a fuel injection ratio map for defining a correspondence between a running state of the engine, and a fuel injection ratio of the first injector and a fuel injection ratio of the second injector with respect to a total fuel injection amount of the fuel injected from the first injector and the fuel injected from the second injector;

a fuel injection ratio setting section for setting the fuel injection ratio of the first injector as a first set value and the fuel injection ratio of the second injector as a second set value, according to the running state of the engine, with reference to the fuel injection ratio map;

a fuel injector control section for controlling a fuel injection amount of the first injector according to the first set value, and a fuel injection amount of the second injector according to the second set value; and a fuel injection ratio compensation section for making compensation such that the first set value is greater than a value of the fuel injection ratio of the first injector which is derived from the fuel injection ratio map, when a condition in which the fuel injection ratio of the second injector which is read out from the fuel injection ratio map according to the running state of the engine is greater in magnitude than a predetermined determination criterion is met.

2. The fuel injection control system according to claim 1, wherein the condition includes a condition in which an increase amount of the fuel injection ratio of the second injector which is read out from the fuel injection ratio map according to the running state of the engine, with respect to a past value of the second set value, is greater than a predetermined threshold.

3. The fuel injection control system according to claim 2, wherein the memory section contains a total fuel injection amount map for defining a correspondence between the running state of the engine and the total fuel injection amount; and when the condition is met, the fuel injection ratio compensation section makes compensation in such a manner that the second set value is less than the value of the fuel injection ratio of the second injector which is derived from the fuel injection ratio map in a state where the total fuel injection amount of the fuel injected from the first injector and the fuel injected from the second injector is equal to the total fuel injection amount derived from the total fuel injection amount map.

4. The fuel injection control system according to claim 3, wherein when the condition is met, the fuel injection ratio compensation section makes compensation such that an increase rate of the second set value is substantially equal to the predetermined threshold.

5. The fuel injection control system according to claim 4, wherein the fuel injection ratio setting section compares the second set value to a predetermined switch threshold;

the fuel injection ratio compensation section uses a first increase rate threshold as the predetermined threshold used to determine whether or not the condition is met, when the second set value is less than the predetermined switch threshold; and the fuel injection ratio compensation section uses a second increase rate threshold greater than the first increase rate threshold as the predetermined threshold used to determine whether or not the condition is met, when the second set value is not less than the predetermined switch threshold.

6. The fuel injection control system according to claim 3, wherein when the condition is met, the fuel injection ratio compensation section sets the second set value such that an increase rate of the second set value increases gradually.

7. The fuel injection control system according to claim 1, wherein the memory section contains a total fuel injection amount map for defining a correspondence between the running state of the engine and the total fuel injection amount; and when the condition is met, the fuel injection ratio compensation section makes compensation in such a manner that the first set value is greater than a value of the fuel injection ratio of the first injector based on the second set value set not greater than the value of the fuel injection ratio which is derived from the fuel injection ratio map such that the total fuel injection amount of the fuel injected from the first injector and the fuel injected from the second injector is greater than the total fuel injection amount derived from the total fuel injection amount map.

8. The fuel injection control system according to claim 7, wherein when the condition is met, the fuel injection ratio compensation section makes compensation such that the second set value is less than the value of the fuel injection ratio of the second injector derived from the fuel injection ratio map, and a compensation amount of the first set value is decided according to a deviation between the second set value and the value of the fuel injection ratio of the second injector derived from the fuel injection ratio map.

9. The fuel injection control system according to claim 7, wherein when the condition is met, the fuel injection ratio compensation section decreases the first set value after a passage of a predetermined period such that the first set value is set to a value corresponding to time delayed by the predetermined period.

10. The fuel injection control system according to claim 9, wherein when the condition is met, the fuel injection ratio compensation section decreases the first set value after the passage of the predetermined period such that the first set value is set to the value corresponding to time delayed by the predetermined period and sets the second set value such that the second set value is less than the value of the fuel injection ratio of the second injector derived from the fuel injection ratio map.

11. The fuel injection control system according to claim 1, wherein the fuel injection ratio setting section sets the first set value and the second set value to values derived from the fuel injection ratio map, respectively, when the fuel injection ratio of the second injector read out from the fuel injection ratio map decreases in response to a decrease in a throttle valve opening degree.

12. The fuel injection control system according to claim 1, wherein the fuel injection ratio compensation section makes compensation such that the second set value is smaller than the value of the fuel injection ratio of the second injector derived from the fuel injection ratio map according to a change rate of a throttle valve opening degree, when the fuel injection ratio of the second injector derived from the fuel injection ratio map decreases in response to a decrease in the throttle valve opening degree.

13. The fuel injection control system according to claim 1, wherein the first injector is disposed downstream of a throttle valve, and the second injector is disposed upstream of the throttle valve.

14. The fuel injection control system according to claim 1, wherein the fuel injection ratio map is set such that the fuel injection ratio of the second injector increases and the fuel injection ratio of the first injector decreases, with an increase in an engine speed or a throttle valve opening degree, and wherein the condition includes a condition in which an increase amount of the fuel injection ratio of the second injector which is read out from the fuel injection ratio map according to the engine speed or the throttle valve opening degree, with respect to a past value of the second set value, is greater than a predetermined threshold.

15. The fuel injection control system according to claim 1, wherein the engine is mounted in a motorcycle.

16. A fuel injection control system comprising:

a first injector for injecting a fuel to an air-intake passage of an engine;

a second injector for injecting the fuel to the air-intake passage, the second injector being position upstream of the first injector in an air flow direction;

a memory section which contains a fuel injection ratio map for defining a correspondence between a running state of the engine and a fuel injection ratio of each of the first injector and the second injector;

a fuel injector control section for controlling a fuel injection amount of the first injector and a fuel injection amount of the second injector, with reference to the fuel injection ratio map; and a fuel injection ratio compensation section for making compensation of the fuel injection amount of the first injector to prevent the fuel injection ratio of the first injector from being rapidly decreased, when a predetermined compensation condition is met.

17. The fuel injection control system according to claim 16, wherein the fuel injection ratio map is set such that the fuel injection ratio of the first injector decreases and the fuel injection ratio of the second injector increases, with an increase in an engine speed or a throttle valve opening degree, and wherein the condition includes a condition in which a decrease amount of the fuel injection ratio of the first injector which is derived from the fuel injection ratio map according to the engine speed or the throttle valve opening degree, with respect to a past value of the first set value, is greater than a predetermined threshold.

* * * * *

UNITED STATES PATENT AND TRADEMARK OFFICE

CERTIFICATE OF CORRECTION

PATENT NO. : 9,188,076 B2
APPLICATION NO. : 13/449236
DATED : November 17, 2015
INVENTOR(S) : Seiichi Kai et al.

It is certified that error appears in the above-identified patent and that said Letters Patent is hereby corrected as shown below:

On the title page of the patent in item 73, insert --Kabushiki-- between “Jukogyo” and “Kaisha”.

Signed and Sealed this
Twenty-ninth Day of March, 2016

Michelle K. Lee

Michelle K. Lee
*Director of the United States Patent and Trademark Office*